US009952532B2

(12) United States Patent
Sugiyama et al.

(10) Patent No.: US 9,952,532 B2
(45) Date of Patent: Apr. 24, 2018

(54) DEVELOPING APPARATUS, ELECTROPHOTOGRAPHIC PROCESS CARTRIDGE, AND ELECTROPHOTOGRAPHIC IMAGE FORMING APPARATUS

(71) Applicant: CANON KABUSHIKI KAISHA, Tokyo (JP)

(72) Inventors: Ryo Sugiyama, Mishima (JP); Yuji Sakurai, Susono (JP); Yoshinobu Ogawa, Numazu (JP); Kazutoshi Ishida, Mishima (JP); Mitsuru Okuda, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/655,945

(22) Filed: Jul. 21, 2017

(65) Prior Publication Data

US 2018/0031997 A1 Feb. 1, 2018

(30) Foreign Application Priority Data

Jul. 29, 2016 (JP) ..... 2016-150119

(51) Int. Cl.
*G03G 15/08* (2006.01)

(52) U.S. Cl.
CPC ..... *G03G 15/0808* (2013.01); *G03G 15/0812* (2013.01)

(58) Field of Classification Search
USPC ..... 399/107, 110, 111, 119, 120, 252, 265, 399/267, 274, 279, 284
See application file for complete search history.

(56) References Cited

U.S. PATENT DOCUMENTS 4,871,649 A 10/1989 Inataki et al.
5,311,264 A * 5/1994 Kinoshita ..... G03G 15/0808 399/279

(Continued)

FOREIGN PATENT DOCUMENTS

| | | | |
|---|---|---|---|
| JP | H04-315179 | A | 11/1992 |
| JP | H08-286497 | A | 11/1996 |
| JP | 2001-109259 | A | 4/2001 |
| JP | 2006-251730 | A | 9/2006 |

OTHER PUBLICATIONS

U.S. Appl. No. 15/440,186, Yuji Sakurai, filed Feb. 23, 2017.

*Primary Examiner* — Hoan Tran
(74) *Attorney, Agent, or Firm* — Fitzpatrick Cella Harper and Scinto

(57) ABSTRACT

The developing apparatus includes: a developing roller rotatable in a first rotation direction; and a developer regulating member, wherein the developing roller includes: a substrate; an electro-conductive elastic layer on the substrate; and insulating domains on the electro-conductive elastic layer, wherein the electro-conductive elastic layer has a certain Martens hardness, the developing roller has a surface including surfaces of the insulating domains and a surface of the electro-conductive elastic layer, which is uncovered with the insulating domains at a certain area ratio, wherein the developer regulating member comprises: an abutting portion which is in contact with the surface of the developing roller, and a certain projection portion extending to an upstream side from the abutting portion in the first rotation direction, the developing apparatus has a certain gap between a side of the projection portion facing to the developing roller, and the surface of the developing roller.

9 Claims, 8 Drawing Sheets

(56) References Cited

U.S. PATENT DOCUMENTS

| | | | | |
|---|---|---|---|---|
| 5,669,047 | A | 9/1997 | Okuda et al. | |
| 6,725,002 | B2 | 4/2004 | Sakurai et al. | |
| 7,201,967 | B2 | 4/2007 | Sakurai et al. | |
| 7,379,693 | B2 | 5/2008 | Ogawa et al. | |
| 7,798,948 | B2 | 9/2010 | Kawamura et al. | |
| 7,979,004 | B2 | 7/2011 | Tanaka et al. | |
| 8,600,273 | B2 | 12/2013 | Yamada et al. | |
| 8,655,238 | B2 | 2/2014 | Uno et al. | |
| 8,660,472 | B2 | 2/2014 | Kurachi et al. | |
| 8,706,011 | B2 | 4/2014 | Anan et al. | |
| 8,768,226 | B2 | 7/2014 | Koyanagi et al. | |
| 8,774,677 | B2 | 7/2014 | Sakurai et al. | |
| 8,798,508 | B2 | 8/2014 | Yamada et al. | |
| 8,837,985 | B2 | 9/2014 | Ishida et al. | |
| 8,846,287 | B2 | 9/2014 | Yamada et al. | |
| 8,909,110 | B2 * | 12/2014 | Nishida | G03G 15/0812 399/284 |
| 8,948,665 | B2 * | 2/2015 | Kase | G03G 15/0812 399/284 |
| 8,998,786 | B2 | 4/2015 | Imasaka et al. | |
| 9,017,239 | B2 | 4/2015 | Ishida et al. | |
| 9,482,986 | B2 | 11/2016 | Sakurai et al. | |
| 2006/0067747 | A1 | 3/2006 | Matsuda et al. | |
| 2006/0226572 | A1 | 10/2006 | Tanaka et al. | |
| 2013/0130022 | A1 | 5/2013 | Uesugi et al. | |
| 2013/0164038 | A1 | 6/2013 | Kusaba et al. | |
| 2013/0266339 | A1 | 10/2013 | Sugiyama et al. | |
| 2017/0097580 | A1 | 4/2017 | Ishida et al. | |

* cited by examiner

DEVELOPING APPARATUS, ELECTROPHOTOGRAPHIC PROCESS CARTRIDGE, AND ELECTROPHOTOGRAPHIC IMAGE FORMING APPARATUS

BACKGROUND OF THE INVENTION

Field of the Invention

The present invention relates to a developing apparatus, an electrophotographic process cartridge, and an electrophotographic image forming apparatus.

Description of the Related Art

A developing method involving using a nonmagnetic one-component toner has been known as the image forming method of an electrophotographic image forming apparatus, such as a copying machine or an optical printer. Specifically, a photosensitive member serving as a rotatable electrostatic latent image-bearing member is charged by a charging unit, such as a charging roller, and an electrostatic latent image is formed by exposing the surface of the charged photosensitive member to laser light. Next, in the developing apparatus of the image forming apparatus, a toner in a developer container is applied onto a developing roller by a developer-regulating member, and the electrostatic latent image is developed with the toner at a contact portion between the photosensitive member and the developing roller. After that, the toner image on the photosensitive member is transferred onto a recording material through or without through an intermediate transfer member in a transferring portion, the toner image is fixed onto the recording material by heat and pressure in a fixing portion, and the recording material having the fixed image is discharged to the outside of the image forming apparatus.

In such image forming method, the developing apparatus includes such members for electrophotography as described below:

(1) a developer-supplying roller present in the developer container and configured to supply the toner to the developing roller;

(2) the developer-regulating member configured to form a toner layer on the developing roller and to keep the amount of the toner on the developing roller constant; and (3) the developing roller configured to develop the image on the photosensitive member with the toner, the roller being arranged so that the roller closes the opening of the developer container storing the toner, part of the roller is exposed to the outside of the container, and the exposed portion faces the photosensitive member.

In the developing apparatus, image formation is performed by the rotation and rubbing of those members for electrophotography.

A reduction in size of the developing apparatus and the energy savings thereof have been advancing in recent years. One method for the reduction in size of the apparatus is a reduction in size of a member for electrophotography, particularly, in diameter of a roller member. In addition, one method for the energy savings is a reduction in torque (a reduction in indentation amount of any such member or a reduction in peripheral speed difference between the members) at the time of the rotation and rubbing of the members for electrophotography. However, when the reduction in torque at the time of the rotation is performed by reductions in diameters of the developing roller and the developer-supplying roller, or the reduction in indentation amount of any such member or the reduction in peripheral speed difference between the members, there is a problem in that the charge amount of the toner layer to be formed on the developing roller becomes insufficient and hence it is difficult to obtain a uniform image. Further, there is a problem in that the charge amount of the toner layer to be formed on the developing roller is liable to be insufficient during printing of an image having a high density such as solid black (region having a maximum image density in a large area).

In Japanese Patent Application Laid-Open No. H08-286497, there is a disclosure of the following developing roller. In order to improve the toner-conveying force of a developing member, a dielectric portion having a high electric resistance value is arranged on the surface of the roller, and the charged dielectric portion is caused to electrically adsorb a toner, thereby enabling the conveyance of the toner. Further, in Japanese Patent Application Laid-Open No. 2006-251730, there is a disclosure of the following developer regulating member. In order to achieve a uniform charge amount of the toner layer, the developer regulating member has a toner reservoir on upstream of an abutting portion, which is to be brought into abutment against the developing roller, in a surface movement direction of the developing roller, thereby being capable of circulating the toner.

According to an investigation made by the inventors of the present invention, it has been found that the developing roller according to Japanese Patent Application Laid-Open No. H08-286497 has an excellent toner-conveying force by virtue of the presence of the dielectric portion on its surface, but the triboelectric charge imparting ability of the developing roller for a toner is degraded. When such a developing roller is used in the formation of an electrophotographic image, "forging" is liable to occur in the electrophotographic image to be obtained. Such tendency has been particularly remarkable when the formation of the electrophotographic image is performed under a high-temperature and high-humidity environment. Further, according to the investigation made by the inventors of the present invention, it has been found that the developer regulating member according to Japanese Patent Application Laid-Open No. 2006-251730 facilitates circulation of a toner by virtue of the toner reservoir so that the charge amount can be set uniform to some extent, but there is room for improving the developer regulating member alone in terms of the effect with respect to a toner charge amount during printing of a solid black image. When such a developer regulating member is used in the formation of an electrophotographic image, "fogging immediately after printing of solid black" is liable to occur in the electrophotographic image to be obtained. Such tendency has been particularly remarkable when the formation of the electrophotographic image is performed under the high-temperature and high-humidity environment.

SUMMARY OF THE INVENTION

The present invention is directed to provide a developing apparatus that can achieve both improvement in toner-conveying force under a high-temperature and high-humidity environment and excellent triboelectric charge imparting ability for a toner during printing of an image having a high density, at high levels. In addition, the present invention is directed to provide an electrophotographic process cartridge and an electrophotographic image forming apparatus that can stably provide high-quality electrophotographic images under various environments.

According to one embodiment of the present invention, there is provided a developing apparatus, including:

a developing roller rotatable in a first rotation direction; and a developer regulating member which is configured to regulate a thickness of a developer layer on the developing roller, wherein the developing roller includes:

a substrate;

an electro-conductive elastic layer on the substrate; and insulating domains on the electro-conductive elastic layer, wherein the electro-conductive elastic layer has a Martens hardness of 0.10 $N/mm^2$ or more and 3.00 $N/mm^2$ or less, the developing roller has a surface including surfaces of the insulating domains and a surface of the electro-conductive elastic layer, which is uncovered with the insulating domains, when assuming that a square of 900 μm on a side is put on a surface of the developing roller, a percentage ratio of an area of the surface of the electro-conductive elastic layer which is uncovered with the insulating domains with respect to an area of the square is 40% or more and 90% or less, and an average of respective areas of portions of the insulating domains, the portions being in contact with the surface of electro-conductive elastic layer is $3.00\times10^2$ $\mu m^2$ or more and $1.00\times10^5$ $\mu m^2$ or less, wherein the developer regulating member includes:

an abutting portion which is in contact with the surface of the developing roller directly or through a developer, and a projection portion extending to an upstream side from the abutting portion in the first rotation direction, the projection portion having a length W1 of 0.5 mm or more, the developing apparatus has a gap between a side of the projection portion facing to the developing roller, and the surface of the developing roller, wherein the gap has a minimum value of distance Hmin of 0.5 mm or less.

Further, according to another embodiment of the present invention, there are provided an electrophotographic process cartridge and an electrophotographic image forming apparatus. The electrophotographic process cartridge includes the developing apparatus, and is detachably mounted to a main body of the electrophotographic image forming apparatus. The electrophotographic image forming apparatus includes the developing apparatus.

Further features of the present invention will become apparent from the following description of exemplary embodiments with reference to the attached drawings.

DESCRIPTION OF THE EMBODIMENTS

Figure 1:
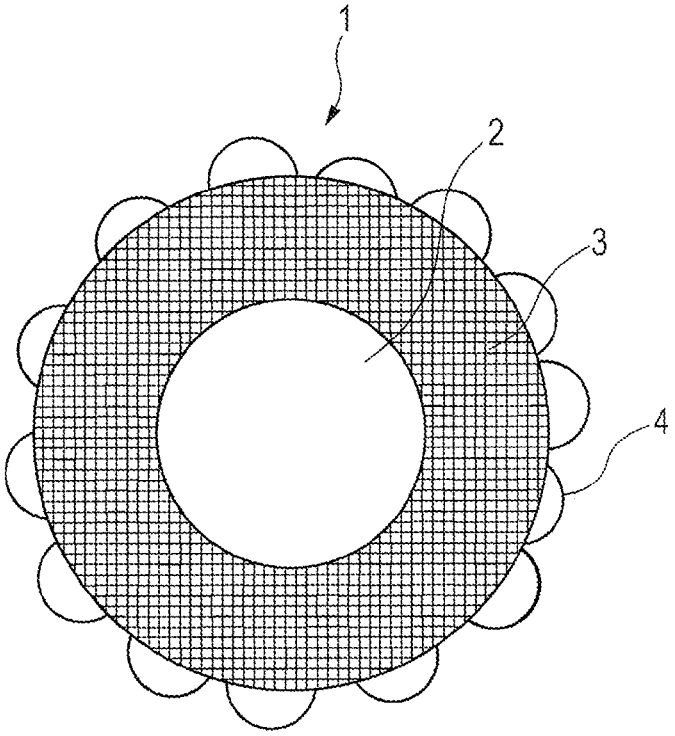
FIG. 1 is a schematic sectional view for illustrating an example of a developing roller of the present invention.

Preferred embodiments of the present invention will now be described in detail in accordance with the accompanying drawings.

A developing apparatus according to one embodiment of the present invention includes a developing roller rotatable in a first rotating direction, and a developer regulating member. The developer regulating member is configured to regulate a thickness of a developer layer on the developing roller. The developing roller includes a substrate, an electro-conductive elastic layer on the substrate, and insulating domains on the electro-conductive elastic layer. The electro-conductive elastic layer has a Martens hardness of 0.10 $N/mm^2$ or more and 3.00 $N/mm^2$ or less. The developing roller has a surface including surfaces of the insulating domains and a surface of the electro-conductive elastic layer, which is uncovered with the insulating domains. When assuming that a square of 900 μm on a side is put on a surface of the developing roller, a percentage ratio of an area of the surface of the electro-conductive elastic layer which is uncovered with the insulating domains with respect to an area of the square is 40% or more and 90% or less.

Further, an average of respective areas of portions of the insulating domains, the portions being in contact with the surface of the electro-conductive elastic layer is $3.00\times10^2$ $\mu m^2$ or more and $1.00\times10^5$ $\mu m^2$ or less.

In the developing roller having insulating domains called dielectric portions in a surface thereof, when the insulating domains are charged, an electric field is generated between each of the domains and the exposed portion of the electro-conductive elastic layer called an electro-conductive portion, and a toner is adsorbed and conveyed by a coulomb force or a gradient force. The conveying force enlarges as the sizes and number of the insulating domains increase. Meanwhile, it has been known that the provision of charge to the toner is generally performed by friction between the developing roller and the toner. However, according to an investigation made by the inventors of the present invention, it has been found that the insulating domains have little involvement in the provision of the charge to the toner. It has been found that because of the foregoing, in the related-art developing roller having the insulating domains, when the sizes and number of the insulating domains are increased for obtaining a large conveying force, the charge-providing performance of the developing roller for the toner reduces instead.

Further, the developer regulating member includes an abutting portion which is in contact with the surface of the developing roller directly or through a developer, and a projection portion extending to an upstream side from the abutting portion in the first rotation direction. The projection portion has a length W1 of 0.5 mm or more. The developing apparatus has a gap between a side of the projection portion facing to the developing roller, and the surface of the developing roller. The gap has a minimum value of distance Hmin of 0.5 mm or less According to the developing apparatus including the aforementioned developing roller rotatable in a first rotating direction, and the aforementioned developer regulating member, the toner conveyed by the developing roller can be regulated by the developer layer thickness regulating portion into a thin layer, and the toner can be stored in the gap portion (toner reservoir portion) surrounded by the a surface of projection portion in a side facing to the developing roller, and a surface of the developing roller. The stored toner circulates in the gap portion, and as a result of that, a fluctuation of the toner charge amount when an image density of an image to be printed is changed, can be prevented more effectively, as compared to a case where a developing apparatus having no gap portion between a developer regulating member and a surface of a developing roller, is used. Further, according to the developing apparatus, the triboelectric charge imparting ability for the toner during printing of an image having a high image density such as solid black, can be improved. Now, the present invention is described in detail.

<Developing Roller>

Figure 2:
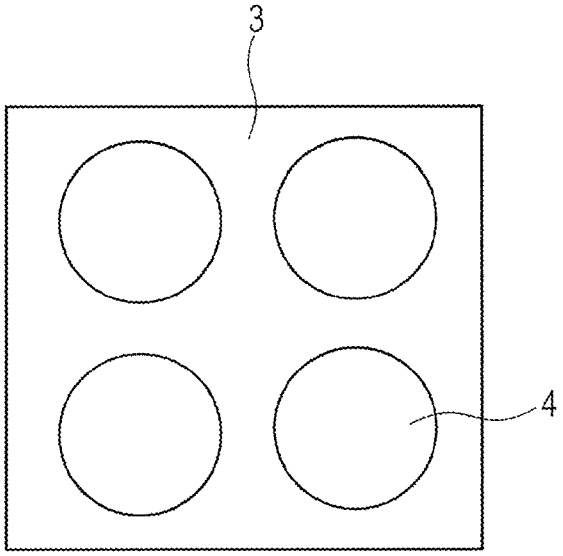
FIG. 2 is a schematic view for illustrating an example of the structure of a surface of the developing roller of the present invention.

As illustrated in FIG. 1, the developing roller of the present invention includes a columnar or hollow cylindrical substrate 2 and an electro-conductive elastic layer 3. As illustrated in FIG. 1, electrically insulating domains 4 are present on the surface of the electro-conductive elastic layer 3. That is, as illustrated in FIG. 2, the surface of the developing roller of the present invention includes the surfaces of the insulating domains 4 and the surface (exposed portion) of the electro-conductive elastic layer 3 not covered with the insulating domains.

[Substrate]

The substrate to be used in the developing roller of the present invention has electro-conductivity and has a function of supporting the electro-conductive elastic layer to be formed thereon. Examples of a material for the substrate may include: metals, such as iron, copper, aluminum, and nickel; and alloys containing these metals, such as stainless steel, duralumin, brass, and bronze. The surface of the substrate may be subjected to a plating treatment for the purpose of imparting scratch resistance to the extent that the electro-conductivity is not impaired. Further, a substrate obtained by covering the surface of a substrate made of a resin with a metal to make the surface electro-conductive or a substrate produced from an electro-conductive resin composition may be used as the substrate.

[Electro-conductive Elastic Layer]

In the developing roller of the present invention, the electro-conductive elastic layer has a single-layer structure or a laminated structure including two or more layers. The electro-conductive elastic layer preferably has the laminated structure including two or more layers. Particularly in a nonmagnetic one-component contact development process, a developing roller which includes the electro-conductive elastic layer having the laminated structure including two layers is suitably used as a developing roller.

The electro-conductive elastic layer contains an elastic material, such as a resin or a rubber. Specific examples of the resin and the rubber include: a polyurethane resin, polyamide, a urea resin, polyimide, a melamine resin, a fluororesin, a phenol resin, an alkyd resin, a silicone resin, polyester, ethylene-propylene-diene copolymerized rubber (EPDM), acrylonitrile-butadiene rubber (NBR), chloroprene rubber (CR), natural rubber (NR), isoprene rubber (IR), styrene-butadiene rubber (SBR), fluororubber, silicone rubber, epichlorohydrin rubber, a hydrogenated product of NBR, and urethane rubber. Of those, silicone rubber may be preferably used. Examples of the silicone rubber may include polydimethylsiloxane, polymethyltrifluoropropylsiloxane, polymethylvinylsiloxane, polyphenylvinylsiloxane, and copolymers of these siloxanes. Those resins and rubbers may be used alone or in combination thereof, as required. In addition, a polyurethane resin is preferred because of the following reasons: the resin is excellent in triboelectric charging performance for a toner; the resin is excellent in flexibility and hence an opportunity for contact with the toner can be easily obtained; and the resin has abrasion resistance. Materials for the resin and the rubber may be identified by measuring the electro-conductive elastic layer with a Fourier transform infrared-visible spectrophotometer.

Examples of the polyurethane resin include an ether-based polyurethane resin, an ester-based polyurethane resin, an acrylic polyurethane resin, and a carbonate-based polyurethane resin. Of those, a polyether polyurethane resin, which easily provides negative charge to the toner through friction with the toner and which easily attains flexibility, is preferred.

The polyether polyurethane resin may be obtained by a reaction of known polyether polyol and a known isocyanate compound. Examples of the polyether polyol include polyethylene glycol, polypropylene glycol, and polytetramethylene glycol. In addition, those polyol components may each be used as a prepolymer obtained by chain elongation thereof in advance with an isocyanate, such as 2,4-tolylene diisocyanate, 2,6-tolylene diisocyanate (TDI), diphenylmethane diisocyanate (MDI), or isophorone diisocyanate (IPDI), as required.

The isocyanate compound to be caused to react with the polyol components is not particularly limited and examples thereof include: aliphatic polyisocyanates, such as ethylene diisocyanate and 1,6-hexamethylene diisocyanate (HDI); alicyclic polyisocyanates, such as isophorone diisocyanate (IPDI), cyclohexane 1,3-diisocyanate, and cyclohexane 1,4-diisocyanate; aromatic polyisocyanates, such as 2,4-tolylene diisocyanate, 2,6-tolylene diisocyanate (TDI), and diphenylmethane diisocyanate (MDI); and modified or copolymerized products thereof and blocked products thereof.

The electro-conductive elastic layer preferably contains an electro-conductive agent for obtaining electro-conductivity. Examples of the electro-conductive agent include an ionic electro-conductive agent and an electronic electro-conductive agent, such as carbon black. Of those, carbon black is preferred because the carbon black can control the electro-conductivity of the electro-conductive elastic layer and the charging performance of the electro-conductive elastic layer for a toner. The volume resistivity of the electro-conductive elastic layer preferably falls within the range of from $1\times10^{3}$ Ω·cm or more to $1\times10^{11}$ Ω·cm or less.

Specific examples of the carbon black may include: electro-conductive carbon black, such as KETJENBLACK (Product name, manufactured by Lion Specialty Chemicals Corporation) or acetylene black; and carbon black for rubber, such as SAF, ISAF, HAF, FEF, GPF, SRF, FT, or MT.

In addition, oxidatively-treated carbon black for a color ink or pyrolytic carbon black may be used. The addition amount of the carbon black is preferably 5 parts by mass or more and 50 parts by mass or less with respect to 100 parts by mass of the resin or the rubber. The content of the carbon black in the electro-conductive elastic layer may be measured with a thermogravimetric analysis apparatus (TGA).

In addition to the above-mentioned carbon blacks, examples of the electro-conductive agent that may be used may include: graphite, such as natural graphite or artificial graphite; powder of a metal, such as copper, nickel, iron, or aluminum; powder of a metal oxide, such as titanium oxide, zinc oxide, or tin oxide; and an electro-conductive polymer, such as polyaniline, polypyrrole, or polyacetylene. Those electro-conductive agents may be used alone or in combination thereof, as required.

In addition to the foregoing, a charge control agent, a lubricant, a filler, an antioxidant, or an aging preventing agent may be incorporated into the electro-conductive elastic layer to the extent that the functions of the resin or the rubber and the electro-conductive agent are not inhibited. In addition, when a surface roughness is required for a developing roller, fine particles for roughness control may be incorporated into the electro-conductive elastic layer. The volume-average particle diameter of the fine particles for roughness control is preferably 3 μm or more and 20 μm or less in order to impart an appropriate surface roughness. In addition, the amount of the fine particles to be incorporated into the electro-conductive elastic layer is preferably 1 part by mass or more and 50 parts by mass or less with respect to 100 parts by mass of the resin or the rubber in order to impart an appropriate surface roughness. Fine particles of, for example, a polyurethane resin, a polyester resin, a polyether resin, a polyamide resin, an acrylic resin, or a polycarbonate resin may be used as the fine particles for roughness control.

The thickness of the electro-conductive elastic layer is preferably 1 μm or more and 5 mm or less to achieve satisfactory developability. The thickness of the electro-conductive elastic layer can be determined through observation and measurement of a cross section thereof with an optical microscope.

[Martens Hardness]

The Martens hardness of the electro-conductive elastic layer of the developing roller according to the present invention is 0.10 $N/mm^2$ or more and 3.00 $N/mm^2$ or less. Setting the Martens hardness within the range imparts moderate softness to the electro-conductive elastic layer. As a result, the number of opportunities for contact between the developing roller and a toner increases, and hence the provision of charge to the toner can be sufficiently performed. In addition, rubbing between each of the insulating domains and the toner can be effectively performed, and hence the charge quantities of the insulating domains increase and a sufficient toner-conveying force can be obtained. When the Martens hardness is less than 0.10 $N/mm^2$, the electro-conductive elastic layer is so soft that the thickness of a toner layer increases and hence the provision of the charge to the toner cannot be sufficiently performed. In addition, when the Martens hardness is more than 3.00 $N/mm^2$, the electro-conductive elastic layer is hard, and the number of opportunities for the contact between the developing roller and the toner reduces, and hence the provision of the charge to the Toner Becomes Insufficient.

[Method of measuring Martens Hardness]

In the present invention, the measurement of the Martens hardness of the electro-conductive elastic layer is performed as described below by using the developing roller. Used as a measuring apparatus is PICODENTOR HM500 (Product name, manufactured by Fischer Instruments K.K.). A Vickers indenter is used as a measurement indenter. The developing roller is arranged to be horizontal to the indenter, and the surface of the electro-conductive elastic layer not covered with the insulating domains in the surface of the developing roller is observed with a microscope. The observation is performed under the conditions of an indenter indentation speed of 1 μm/sec, a maximum indentation load of 0.1 mN, and an indentation time of 20 seconds. The Martens hardness is represented by the equation "maximum indentation load/26.43×indentation depth," and is calculated by detecting the "indentation depth."

[Insulating Domains]

The insulating domains are present in a partial region on the surface of the developing roller according to the present invention. That is, the surface of the developing roller includes the surfaces of the insulating domains and the exposed portion of the electro-conductive elastic layer not covered with the insulating domains. The volume resistivity of each of the insulating domains is preferably $1\times10^{13}$ Ω·cm or more and $1\times10^{18}$ Ω·cm or less, more preferably $1\times10^{14}$ Ω·cm or more and $1\times10^{17}$ Ω·cm or less. When the volume resistivity is within the above-mentioned range, this is because the insulating domains can be easily charged.

Examples of a material constituting the insulating domains include a resin and a metal oxide. Of those, a resin is preferred. Specific examples of the resin include an acrylic resin, a polyolefin resin, an epoxy resin, and a polyester resin. Of those, an acrylic resin is preferred because the volume resistivity of each of the insulating domains can be easily adjusted to fall within the range. Specific examples of the acrylic resin include: methyl methacrylate, 4-tert-butylcyclohexanol acrylate, stearyl acrylate, lauryl acrylate, 2-phenoxyethyl acrylate, isodecyl acrylate, isooctyl acrylate, isobornyl acrylate, 4-ethoxylated nonylphenol acrylate, and ethoxylated bisphenol A diacrylate.

Examples of a method of forming the insulating domains on the electro-conductive elastic layer include various printing methods. Of those, a jet dispenser method and an inkjet method are preferred in order that the insulating domains may be caused to exist in a partial region on the surface of the electro-conductive elastic layer.

The Martens hardness of each of the insulating domains of the present invention is preferably from 100 $N/mm^2$ to 800 $N/mm^2$. Through setting of the Martens hardness within the above-mentioned range, a sufficient toner conveyance amount can be obtained.

[Exposure Ratio of Electro-conductive Elastic Layer]

In the surface of the developing roller of the present invention, the ratio of the area of the electro-conductive elastic layer which is uncovered with the insulating domains, i.e. exposed portion of the electro-conductive elastic layer, to the area of a square 900 μm on a side defined as 100% (hereinafter also referred to as "exposure ratio $R_E$") is preferably 40% or more and 90% or less. The exposure ratio $R_E$ is more preferably 50% or more and 80% or less. Setting the exposure ratio $R_E$ within the above-mentioned range can adjust the toner-conveying force of the developing roller to a proper amount, and enables sufficient rubbing between the electro-conductive elastic layer and a toner. As a result, the developing roller can sufficiently provide the toner with triboelectric charge. In addition, a sufficient toner-conveying force can be obtained even under a high-temperature and high-humidity environment.

[Areas of Insulating Domains]

The average of the areas of the portions of the respective insulating domains in contact with the electro-conductive elastic layer (hereinafter also referred to as "average base area $S_D$") is preferably $3.00\times10^2$ $\mu m^2$ or more and $1.00\times10^5$ $\mu m^2$ or less. The average base area $S_D$ is more preferably $1.00\times10^3$ $\mu m^2$ or more and $5.00\times10^4$ $\mu m^2$ or less. Setting the average base area $S_D$ within the above-mentioned range can adjust the toner-conveying force of the developing roller to a proper amount, and enables sufficient rubbing between the developing roller and a toner. In addition, as a result of the foregoing, the conveying force of the developing roller for the toner improves and its triboelectric charge imparting ability for the toner also improves.

[Heights of Insulating Domains]

An average $H_D$ of the heights of the respective insulating domains from the portions in contact with the electro-conductive elastic layer, may preferably 0.5 μm or more and 15.0 μm or less. The heights of the respective insulating domains can also be defined as distances between interfaces of the respective insulating domains and the electro-conductive elastic layer, and respective peaks of the insulating domains. When the average $H_D$ of the heights is set to 0.5 μm or more, the toner-conveying force can be easily obtained. When the average $H_D$ of the heights is set to 15.0 μm or less, rubbing between the electro-conductive elastic layer and a toner easily occurs, and hence the provision of charge to the toner can be easily performed.

[Intervals Between Insulating Domains]

An average of intervals between the insulating domains (hereinafter also simply referred to as "average of intervals") is preferably from 10 μm or more and 1,000 μm or less. Through setting of the average of intervals to 10 μm or more, rubbing between the electro-conductive elastic layer and the toner is more likely to occur so that the triboelectric charge is more likely to be imparted to the toner. Further, through setting of the average of intervals to 1,000 μm or less, the toner-conveying force is more likely to be obtained.

[Method of measuring Exposure Ratio of Electro-conductive Elastic Layer]

In the present invention, the exposure ratio $R_E$ of the electro-conductive elastic layer is measured as described below. An objective lens having a magnification of 20 is installed in a laser microscope VK-100 (Product name, manufactured by Keyence Corporation), and the surface of the developing roller in a region of 3 mm×3 mm is observed to perform image connection. Next, the resultant observation image is subjected to inclination correction. The inclination correction is performed in a quadratic surface correction mode. The exposure ratio of the electro-conductive elastic layer in a square area 900 μm on a side at the center of the corrected image is measured. The measurement is performed by using an image processing software, such as ImageJ. The measurement of the exposure ratio is performed for 10 points of the developing roller (1 site of each of 10 regions obtained by dividing the member into 10 equal sections in its longitudinal direction), and the arithmetic average of the measured values is defined as the exposure ratio $R_E$ of the present invention.

[Method of Measuring Average Base Area of Insulating Domains]

Similarly to the measurement of the exposure ratio, an image subjected to the inclination correction is used in the measurement of the average base area $S_D$ of the insulating domains, and the insulating domains falling within the image are subjected to the measurement. As in the exposure ratio, 10 points of the developing roller are observed, and the arithmetic average of the resultant values is defined as the average base area $S_D$ of the present invention. At that time, all the insulating domains completely included in a square area 900 μm on a side are defined as measuring objects, and the insulating domain that is not completely included therein is not defined as a measuring object.

[Method of Measuring Average Heights of Insulating Domains]

Similarly to the measurement of the exposure ratio, an image subjected to the inclination correction is used in the measurement of the average $H_D$ of the heights of the insulating domains, and the insulating domains falling within the image are subjected to the measurement. A difference "$H_2-H_1$" between a highest point $H_2$ of the insulating domains and a height $H_1$ of the electro-conductive elastic layer is calculated by using the resultant three-dimensional observation image. Observation of 10 points of the developing roller (1 site of each of 10 regions obtained by dividing the developing roller into 10 equal sections in its longitudinal direction) is performed, and the arithmetic average of the resultant "$H_2-H_1$" values is defined as the average $H_D$ of the heights of the insulating domains of the present invention. At that time, all the insulating domains completely included in a square area 900 μm on a side are defined as measuring objects, and the insulating domain that is not completely included therein is not defined as a measuring object.

[Method of Measuring Average of Intervals Between Insulating Domains]

Similarly to the measurement of the exposure ratio, an image subjected to inclination correction is used in the measurement of the average of intervals between insulating domains, and the insulating domains falling within the image are subjected to the measurement. A distance between center points of insulating domains adjacent to each other in the resultant observation image is calculated. At that time, all the insulating domains completely included in a square area 900 μm on a side are defined as measuring objects, and the insulating domain that is not completely included therein is not defined as a measuring object. As in the exposure ratio, 10 points of the developing roller are observed, and the arithmetic average of the resultant values is defined as the average of intervals between the insulating domains of the present invention.

When the jet dispenser method or the inkjet method is used, the base areas and height of the insulating domains can be regulated by conditions, such as the kind of their material and an ejection amount.

<Developer Regulating Member>

The developer regulating member of the present invention includes an abutting portion which is in contact with the surface of the developing roller directly or through a developer, and a projection portion extending to an upstream side from the abutting portion in the first rotation direction. The projection portion has a length W1 of 0.5 mm or more. Hereinafter, the length W1 also referred to as "projection length" or "projection amount". The developing apparatus has a gap between a side of the projection portion facing to the developing roller, and the surface of the developing roller. The gap has a minimum value of distance Hmin of 0.5 mm or less.

According to the developing apparatus of the present disclosure provided with the above developer regulating member, both improvement in toner-conveying force under a high-temperature and high-humidity environment, and excellent triboelectric charge imparting ability for a toner during printing of an image having a high density, can be achieved at high levels. The assumed reasons have surmised as follows.

In a process of forming an image whose image density is low such as a solid white image whose image density is 0%, and toner on the developing roller is not transferred to the photosensitive member at a developing stage, there is a tendency that the toner which remains on the developing roller after the developing stage, is repeatedly rubbed between the developing roller and the developer regulating member or between the developing roller and the developer-supplying roller, and triboelectric charging causes increase in toner charge amount. Meanwhile, in a process of forming an image whose image density is high such as a solid black image whose image density is 100%, and almost all the toner on the developing roller is transferred to the photosensitive member at a developing stage, a toner which is additionally supplied from the developer container takes up a major part of the toner on the developing roller. The additionally supplied toner has less history of being rubbed by the developer regulating member or by the developer-supplying roller, and the triboelectric charging is not sufficient. Accordingly, there is a tendency that the toner charge amount is reduced. Further, when the development with a high image density is performed as in the case of solid black, there is a tendency that the toner conveyance amount on the developing roller is reduced. Such tendency is remarkable when the developer-supplying roller is rotated in a forward direction relative to the developing roller or is rotated to follow the rotation of the developing roller. This is because reduction in torque resulting therefrom causes reduction in rubbing of the toner on the developing roller by the developer-supplying roller and reduction in toner supply amount to the developing roller by the developer-supplying roller.

In this regard, the inventors of the present invention have found that the developing apparatus which includes the developer regulating member in addition to the developing roller has an excellent triboelectric charge imparting ability for a toner also during printing of the solid black image, thereby being capable of further reducing the "fogging immediately after printing of solid black." The inventors of the present invention considered that such feature could be achieved because the above-mentioned developing apparatus was capable of promoting not only the circulation of the toner conveyed by the developing roller in the gap portion but also the rubbing of the toner being present on the surface of the developing roller in the gap portion.

The first reason why the inventors of the present invention considered in such a manner was as follows. The developer regulating member, which has a distance Hmin of 0.5 mm or less between the surface of the projection portion and the surface of the developing roller at the position at which the surface of the projection portion and the surface of the developing roller are closest to each other, and the developing roller having the excellent toner-conveying force are combined. As a result, such combination expressed the effect more significantly with respect to the "fogging immediately after printing of solid black". Through use of the above-mentioned developer regulating member, the gap portion becomes narrower. Further, through use of the above-mentioned developing roller, more toner is conveyed to the gap portion. Consequently, it is conceivable that the state in which the toner is intensively filled in the gap portion was required to express the effect more significantly. It is conceivable that the state in which the toner is intensively filled is a state in which circulation of the toner is less likely to occur in the gap portion, whereas rubbing is more likely to occur between the surface of the developing roller being rotated and the toner being intensively filled. Consequently, the inventors surmised that it is more important to promote rubbing of the toner which is present on the surface of the developing roller than to circulate the toner in the gap portion.

The second reason is as follows. The developing roller, which has the above-mentioned exposure ratio and Martens hardness in the electro-conductive elastic layer, and the developer regulating member, which has the projection amount of 0.5 mm or more, are combined. As a result, such combination expressed the effect more significantly with respect to the "fogging immediately after printing of solid black". As described above, the developing roller of the present invention allows the electro-conductive elastic layer having the high triboelectric charge imparting ability for the toner to be exposed with a ratio of 40% or more and 90% or less, and has a suitable flexibility, that is, has a Marten hardness of 0.10 $N/mm^2$ or more and 3.00 $N/mm^2$ or less in the electro-conductive elastic layer. Accordingly, the contact area with the toner is secured, thereby exerting excellent triboelectric charge imparting ability for the toner. Further, it is conceivable that the projection amount corresponds to a distance which enables rubbing between the toner, which is intensively filled in the gap portion, and the surface of the developing roller. The triboelectric charge imparting ability for the toner on the surface of the developing roller and the rubbing distance with respect to the surface of the developing roller expressed the effect with respect to the "fogging immediately after printing of solid black". Therefore, it is conceivable that it is important to promote the rubbing of the toner, which is present on the surface of the developing roller, in the gap portion.

Although it was mere speculation, the inventors considered that the developing roller of the present invention could exert the effect more significantly because the exposed portion of the electro-conductive elastic layer, which had the excellent toner-conveying force enabling intensive filling of the toner in the gap portion and had the excellent triboelectric charge imparting ability for the toner, had a small adhesion force with respect to the toner. In order to cause the toner to be efficiently charged, it is important that the toner roll at the time of being rubbed. In order to cause the toner to roll, it is required that the adhesion force between the toner and the surface on which the toner rolls be small. When the insulating domains are charged, and the toner is adsorbed to the charged insulating domains, as described above, the developing roller of the present invention exerts the excellent toner-conveying force. Meanwhile, the exposed portion of the electro-conductive elastic layer is not charged. Accordingly, an adsorption force with respect to the toner is not generated, with the result that the adhesion force is maintained low. As described above, the developing roller of the present invention is capable of causing the toner to roll on the exposed portion of the electro-conductive elastic layer, while the developing roller has the excellent toner-conveying force required to intensively fill the toner in the gap portion. Therefore, the inventors considered that the effect could be exerted more significantly with the developing apparatus including the developing roller combined with the developer regulating member of the present invention. When a magnetic development process using a magnetic toner and a magnetic pole is employed, a toner-conveying force by virtue of a magnetic force is given, and an adsorption force by virtue of the magnetic force is applied to an entire region on a surface of the developer carrying member. Therefore, it is conceivable that rolling of the toner on the surface of the developer carrying member is liable to be hindered. When there is used a developing roller which includes no insulating domain, which includes insulating domains having an area and a height smaller than a range of the present invention or smaller than a preferred range, or which has a high exposure ratio of the electro-conductive elastic layer, the toner cannot be intensively filled in the gap portion. Therefore, it is conceivable that there is difficulty in rubbing and rolling of the toner on the surface of the developing roller. Further, when there is used a developing roller which includes insulating domains having an area and a height larger than the range of the present invention or smaller than a preferred range, or has a low exposure ratio of the electro-conductive elastic layer, the region in which the toner can roll may become narrower, or the friction opportunity is reduced. Therefore, it is conceivable that the effect is less likely to be obtained. It is surmised that rubbing and rolling of the toner can be made because, as described above, the adhesion force with the toner on the exposed portion of the electro-conductive elastic layer of the surface of the developing roller is small. Further, it is surmised that the significant effect could be expressed because the triboelectric charge imparting ability for the toner on the surface of the developing roller on which the toner is rubbed and rolled is set higher and because the distance by which the toner is rubbed and rolled, that is, the projection amount of the developer regulating member is set longer.

Based on the reasons described above, the inventors considered that, with the developing apparatus including the combination of the developer regulating member and the developing roller, the excellent toner charge imparting ability was given also during the printing of the solid black image, and the "fogging immediately after printing of solid black" could be further improved.

Now, one example of the developer regulating member used in relation to the present invention is described.

The developer regulating member of the present invention includes at least a support portion and a blade portion. The support portion and the blade portion may be integrally formed with use of a single material, or may be separately formed with use of a single material and be combined with each other. Further, the support portion and the blade portion may be separately formed with use of different materials and be combined with each other. The support portion used for the above-mentioned developer regulating member is not particularly limited as long as the support portion is capable of supporting the blade portion.

Figure 7A:
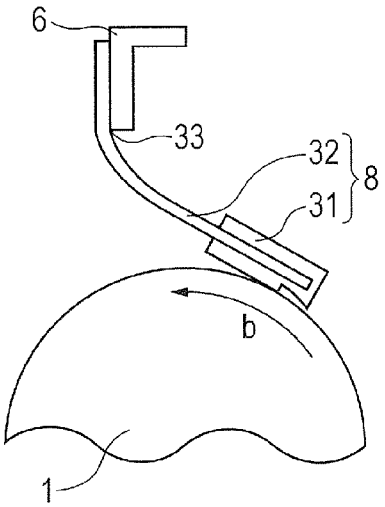
FIG. 7A, FIG. 7B, FIG. 7C, and FIG. 7D are sectional views for illustrating schematic structures of examples of the developing apparatus according to the present invention.
Figure 7B:
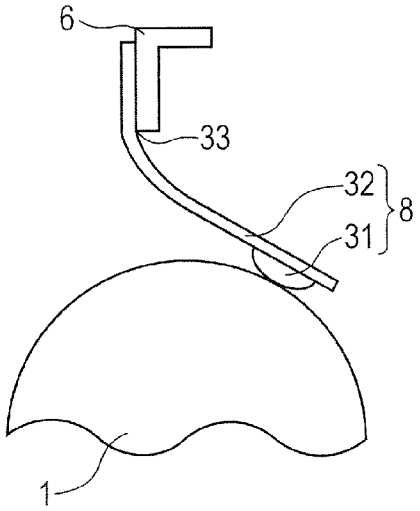
Figure 7C:
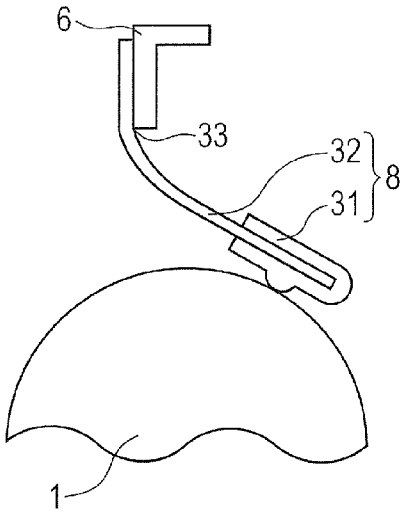
Figure 7D:
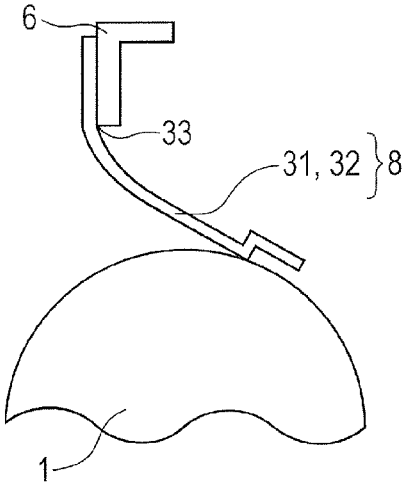

Specifically, the developer regulating member which is produced with use of the support portion and the blade portion may be those illustrated in FIG. 7A to FIG. 7D. FIG. 7A to FIG. 7D are sectional views for illustrating examples of the developing apparatus according to the present invention including the developer regulating member and the developing roller, which are taken along a direction perpendicular to a longitudinal direction of the developing apparatus. The developer regulating members 8 illustrated in FIG. 7A, FIG. 7B, and FIG. 7C are each constructed by a support portion 32 and a blade portion 31. Further, the developer regulating member 8 illustrated in FIG. 7D is constructed so that the support portion 32 and the blade portion 31 are integrally formed with use of a single material. Such developer regulating member 8 is fixed to a developer container 6 and is brought into contact with a surface of the developing roller with a fixed point 33, which is held in contact with an opening end of the developer container 6, as a support point.

A material for the support portion may be any material, such as a metal or a resin, and specific examples thereof may include: metals, such as stainless steel, phosphor bronze, and aluminum; and resins, such as polyethylene terephthalate, an acrylic resin, polyethylene, and polyester. When a resin is used and electro-conductivity is required, an electro-conductive material is preferably added to the resin. When the support portion and the blade portion are formed by using a single material so as to be integrated with each other, the same material as that for the support portion is used for the blade portion.

The thickness of the support portion is not particularly limited, but is preferably 0.05 mm or more and 0.15 mm or less. When the thickness of the support portion is 0.05 mm or more, the developer regulating member may be held in abutment against the developing roller with a suitable contact pressure, thereby being capable of regulating the toner on the developing roller to a suitable layer thickness. Meanwhile, when the thickness of the support portion is 0.15 mm or less, the developer regulating member can easily follow the developing roller and have elasticity to apply a required pressure to the toner.

As a forming method to be employed in the case of integrally forming the support portion and the blade portion with use of a single material, there may be employed electrochemical machining, electric discharge machining, or laser beam machining, other than bending through use of a press machine or the like.

When the blade portion is formed by using a material different from that for the support portion, any one of a thermosetting resin and a thermoplastic resin may be used. Examples of the thermosetting resin include resins such as a silicone resin, a urethane resin, a phenol resin, a urea resin, a melamine resin, an acrylic resin, and an epoxy resin. Examples of the thermoplastic resin include resins such as polyethylene terephthalate, an acrylic resin, polyethylene, polyamide, and polyester. Of those, a thermoplastic resin is preferred because the resin can be easily deformed into a desired shape by applying heat.

When the support portion and the blade portion are made of different materials, the thickness of the blade portion is not particularly limited, but it is preferred that the thickness of the abutting portion on the support portion surface (reference symbol "d" in FIG. 8A to FIG. 8D) be 10 μm or more and 1,000 μm or less. When the thickness of a film of the abutting portion on the support portion surface is 10 μm or more, durability with respect to wear due to friction with the developing roller can be secured. When the thickness is 1,000 μm or less, a stable contact pressure with the developing roller can be obtained.

A portion at which the blade portion is formed is not particularly limited. The blade portion may be formed on one surface of the support portion on a side which is to be brought into abutment against the developing roller, or may have a shape of covering both surfaces of the support portion on the abutment side and a non-abutment side. Alternatively, the blade portion may be formed on one surface of the support portion on the non-abutment side as long as the blade portion is formed so as to be brought into abutment against the developing roller. The shape of the blade portion at the portion which is to be brought into abutment against the developing roller is also not particularly limited, and the blade portion may have any one of a flat surface, a curved surface, a protruding shape, and a recessed shape.

Further, the blade portion of the developer regulating member of the present invention may have a step portion 31*b*. With the step portion 31*b*, an edge portion which is configured to regulate the developer layer thickness can be secured. Accordingly, adjustment of the layer thickness of the developer can easily be performed. It is preferred that the thickness of the step of the step portion 31*b* is 0.05 mm or more and 1 mm or less. FIG. 8A, FIG. 8B, FIG. 8C, and FIG. 8D are enlarged views corresponding to FIG. 7A, FIG. 7B, FIG. 7C, and FIG. 7D which are sectional views for illustrating examples of the developing apparatus taken along a direction perpendicular to the longitudinal direction of the developing apparatus. In the developer regulating members illustrated in FIG. 8A to FIG. 8D, the surface of the projection portion, which is opposed to the surface of the developing roller, has a straight profile line. Specifically, the blade portion has a step portion 31*b* and a projection portion 31*c*, which is held in non-contact with the surface of the developing roller, on upstream of an abutting portion 31*a* with respect to the developing roller 1 in the conveyance direction of the developer. Herein, the "upstream in the conveyance direction of the developer" corresponds to, as illustrated in FIG. 8A to FIG. 8D, the X-side of the arrow b in the developing roller 1, the arrow b showing a first rotation direction of the developing roller. The abutting portion 31*a* constructs a part of the developer layer thickness regulating portion which is configured to regulate the developer layer thickness. The minimum distance Hmin of the gap between the surface of the developing roller 1 and the surface of the projection portion 31*c* at a position at which the surface of the developing roller 1 and the surface of the projection portion 31*c* is 0.5 mm or less. With the distance Hmin set to 0.5 mm or less, when the developer regulating member is combined with the developing roller having the excellent toner-conveying force as described above, the toner can be more intensively filled in a gap portion 31*e* (toner reservoir portion) formed of the step portion 31*b*, the projection portion 31*c*, and the surface of the developing roller.

Further, a projection length W1 of the projection portion is 0.5 mm or more. With the projection length W1 set to 0.5 mm or more, when the developer regulating member is combined with the developing roller having the excellent triboelectric charge imparting ability for the toner as described above, the toner can be charged more significantly in the gap portion. The projection length W1 of the projection portion is a length from a root 31*d* of the projection portion to a distal end of the projection portion. The root 31*d* is also defined as a connecting point of the step portion 31*d* and the projection portion 31*c*.

Figure 9A:
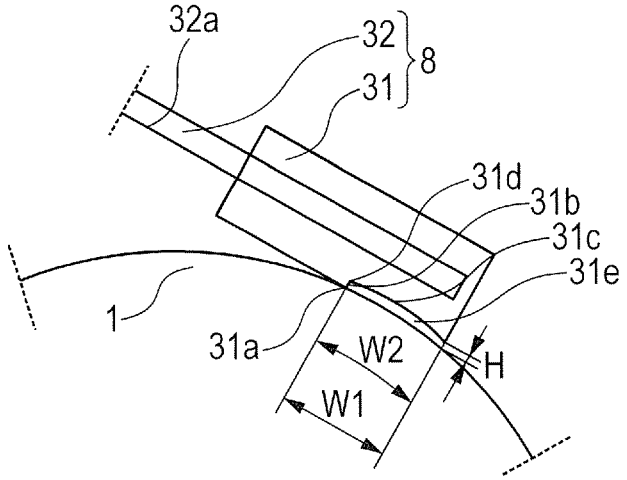
FIG. 9A, FIG. 9B, and FIG. 9C are enlarged sectional views for illustrating schematic structures of examples of the developing apparatus according to the present invention.
Figure 9B:
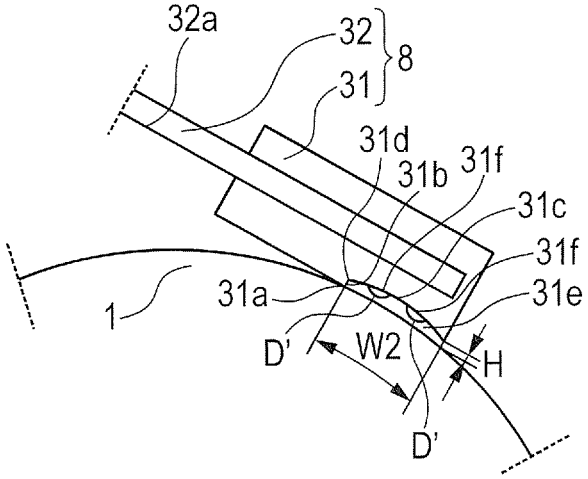
Figure 9C:
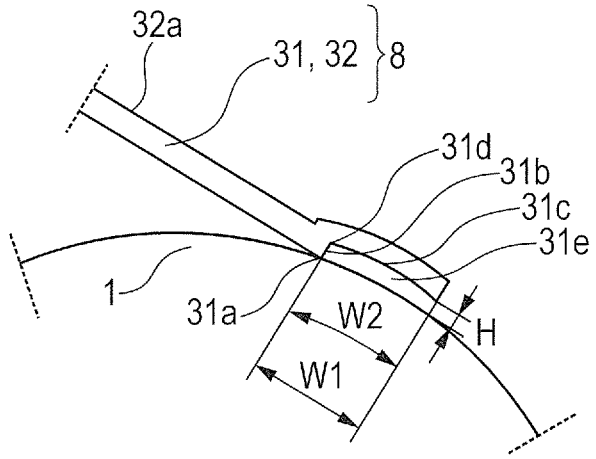

FIG. 9A, FIG. 9B, and FIG. 9C are enlarged sectional views for illustrating other examples of the developing apparatus according to the present invention, which are taken along a direction perpendicular to the longitudinal direction. Each of the developer regulating members illustrated in FIG. 9A to FIG. 9C, has the projection portion having a region in which a profile line of the surface of the projection portion facing to the surface of the developing roller, has a concave shape toward the developing roller. FIG. 9A shows a developer regulating member of which the profile line has a curved shape. FIG. 9B shows a developer regulating member of which the profile line has a shape having a bent straight line. Further, FIG. 9C shows a developer regulating member having the support portion and the blade portion which are integrally formed with use of a single material, and the profile line has a shape which is curved in the concave shape. In the present invention, as shown in FIG. 9A to FIG. 9C, developer regulating members provided with a projection portion having a region in which a profile line of the surface facing to the developer roller has a concave shape, the region having an area at which the gap distance H is 0.05 mm or more and 0.5 mm or less, and a surface length W2 of the profile line in the area being 0.5 mm or more, are preferable. With such a shape of the projection portion, a gap portion in a state in which the toner is intensively filled can be formed over a larger distance along a rotating direction of the developing roller. Consequently, the toner can be more easily charged in the gap portion. The "length of the surface" of the length W2 of the profile line of the surface of the projection portion is, within a region in which the distance H between the projection portion and the surface of the developing roller is 0.05 mm or more and 0.5 mm or less, a sum of lengths of straight line segments in the shape of the bent straight line, and a length along a curve of a curved line portion in the curved shape.

According to the present invention, when defining a point on a profile line of a surface of the projection portion in a side facing to the developing roller, is a first point, and a cross point of a line connecting the first point and a rotation center of the developing roller, and a surface of the developing roller, is a second point, an angle D formed between a first tangential line at the first point, and a second tangential line at the second point, may preferably be −5° or more and +5° or less. Herein, the positive angle corresponds to a direction in which the projection portion is opened toward upstream of the rotating direction of the developing roller, and the negative angle corresponds to a direction in which the projection portion is closed toward the upstream in the rotating direction of the developing roller.

In the developer regulating member provided with a projection portion having the region of which the profile line has a concave shape, the angle D is an angle formed between the first tangential line in the first point set on a profile line in the region and the second tangential line at the second point.

Specifically, as illustrated in FIG. 8A to FIG. 8D, when the profile line is a straight line, the straight line is set as the first tangential line (A). A second tangential line (A') at a cross point of a line segment connecting each point, excluding points at both ends, of 0.1 mm pitch on the first tangential line (A) and a rotation center of the developing roller, and a surface of the developing roller, is determined. Then, an angle D formed between the first tangential line A and the second tangential line A' is determined at each point.

Further, as illustrated in FIG. 9A to FIG. 9C, when the profile line is curved in a concave shape, at each point (however, excluding points at both ends) of 0.1 mm pitch along the projection portion, a circle passing three points, which includes a center point and points apart from the center point by 0.1 mm on upstream and downstream, is measured, and a first tangential line (A, not shown) at the center point of the circle passing three points is determined. Further, a second tangential line (A', not shown) at a cross point of a line segment connecting the center point and a rotation center of the developing roller is similarly determined. Then, the angle D formed by the first and second tangential lines determined.

When the formed angle is 5.0° or less, the projection portion is not excessively opened toward the upstream in the rotating direction of the developing roller, thereby being capable of intensively filling the toner in the gap portion 31*e* (toner reservoir portion) which is formed of the step 31*b*, the projection portion 31*c*, and the surface of the developing roller. As a result, the toner can easily be charged, which is preferred. Further, when the formed angle is −5.0° or more, excessive filling of toner which may cause formation of a stagnation layer in the gap portion can be suppressed. As a result, fluctuation in image density (rise in density at a second-turn position of the developing roller 2 from a leading end of the image) due to discharging of a toner formed into an aggregate (lump) in the stagnation layer from the gap portion at the time of printing of a solid black image can easily be suppressed, which is preferred.

Further, according to the present invention, when a distance (distance of the gap portion) between the surface of the projection portion 31*c* and the surface of the developing roller 1 at the position at which the surface of the projection portion 31*c* and the surface of the developing roller 1 are closest to each other is defined as the minimum distance Hmin, and a distance (distance of the gap portion) between the surface of the projection portion 31*c* and the surface of the developing roller 1 at a position at which the surface of the projection portion 31*c* and the surface of the developing roller 1 are farthest from each other is defined as a maximum value of distance Hmax, it is preferred that a change ratio C of the distances of the gap portion as expressed by (Hmax/Hmin) be 1.0 or more and 3.0 or less. Here, the ratio (Hmax/Hmin) may be referred as a change ratio C. When the change ratio C is set within the above-mentioned range, the toner can be more uniformly filled in the gap portion. Therefore, the toner can be more stably charged, which is preferred.

The length of the projection portion, the formed angle, and the change ratio which determine a distance between the projection portion and the surface of the developing roller as mentioned above can easily be achieved by forming the surface of the projection portion into the shape of being curved in a concave shape particularly in the case of increasing the length of the projection portion. Such a shape of being curved in a concave shape may include a shape formed of a bent straight line and a curved shape. In view of the length W2 of the profile line of the surface of the projection portion, the formed angle, and the change ratio, the curved shape is preferred.

The formation of the blade portion may be performed by, for example, extrusion molding, application molding, sheet-bonding molding, or injection molding. Specifically, when the extrusion molding is adopted, the blade portion is formed by: placing the support portion having applied thereto an adhesive as required in a molding die; and injecting the thermoplastic resin that has been heated and melted into the molding die. In addition, when the sheet-bonding molding is adopted, the thermoplastic resin that has been molded into a sheet shape by the extrusion molding or the like is bonded to the support portion having applied thereto an adhesive. In addition, when the injection molding is adopted, the blade portion is formed by injecting the thermoplastic resin into a die cavity and cooling the resin.

At the time of the formation of the blade portion, an adhesive layer may be formed on the support portion as required. Examples of a material for the adhesive layer may include hot-melt adhesives, such as polyurethane-, polyester-, ethylene-vinyl alcohol (EVA)-, and polyamide-based adhesives.

In addition, an electro-conductive agent may be added as required for imparting electro-conductivity to the support portion, the blade portion, or the optional adhesive layer. Examples of the electro-conductive agent include an ionic electro-conductive agent, carbon black, graphite, a carbon fiber, a carbon nanofiber, a carbon nanotube, graphene, a metal particle, a metal fiber, a metal oxide, and an electro-conductive polymer.

Examples of the kind of the ionic electro-conductive agent include: a perchlorate, a chlorate, a hydrochloride, a bromate, an iodate, a hydrofluoroborate, a trifluoromethylsulfate, a sulfonate, or a bis(trifluoromethylsulfonic acid) imide salt containing an ammonium ion, such as tetraethylammonium, tetrabutylammonium, lauryltrimethylammonium, dodecyltrimethylammonium, stearyltrimethylammonium, octadecyltrimethylammonium, hexadecyltrimethylammonium, benzyltrimethylammonium, or a modified aliphatic dimethylethylammonium; and a perchlorate, a chlorate, a hydrochloride, a bromate, an iodate, a hydrofluoroborate, a trifluoromethylsulfate, a sulfonate, or a bis(trifluoromethylsulfonic acid) imide salt containing an alkali metal or an alkaline earth metal, such as lithium, sodium, calcium, or magnesium. Of those, a trifluoromethylsulfate and a bis(trifluoromethylsulfonic acid) imide salt of an alkali metal or an ammonium ion are preferred. Those salts are suitable because each of the salts has an anion structure containing a fluorine atom and hence exhibits a large electro-conductivity-imparting effect. The ionic electro-conductive agents may be used alone or in combination thereof.

[Shape Measurement for Developing Apparatus]

Shape measurement for the developing apparatus was performed in the manner described below. The state in which the developer regulating member 8 and the developing roller 1 were held in abutment against each other as illustrated in FIG. 8A to FIG. 8D was observed from the cross-sectional direction which was perpendicular to the longitudinal direction of the developer regulating member 8 through use of a digital microscope (Product name: VHX-5000, manufactured by Keyence Corporation) with magnification of 500 times. Then, the projection length W1 of the projection portion 31*c* and the minimum gap distance Hmin between the surface of the projection portion 31*c* and the surface of the developing roller 1 at the position at which the surface of the projection portion 31*c* and the surface of the developing roller 1 are closest to each other were measured. Further, the maximum value of distance Hmax between the surface of the projection portion 31*c* and the surface of the developing roller 1 at the position at which the surface of the projection portion 31*c* and the surface of the developing roller 1 are farthest from each other was measured. At this time, the ratio (Hmax/Hmin) of the maximum value of distance Hmax to the minimum value of distance Hmin was defined as the change ratio C.

Further, for the developer regulating member 8 including the projection portion 31*c* with the surface, which was opposed to the developing roller and had the profile line curved in a concave shape as illustrated in FIG. 9A to FIG. 9C, the length W2 of the profile line of the surface of the projection portion within the range in which the distance H with respect to the surface of the developing roller 1 was 0.05 mm or more and 0.5 mm or less was measured. The length W2 is a distance which is obtained by measuring distances with respect to the surface of the developing roller at 0.1 mm pitches along the projection portion, and all of the measured values fall within the range of from 0.05 mm to 0.5 mm. An arithmetic average of the distances H with respect to the surface of the developing roller 1 at that time was defined as an average gap distance Havg, and the ratio (Hmax/Hmin) of the maximum value of distance (Hmax) of the distances H to the minimum value of distance (Hmin) of the distances H was defined as the change ratio C.

Further, at each point (however, excluding points at both ends) of 0.1 mm pitch along the surface of the projection portion which is opposed to the developing roller, a circle passing three points, which includes a center point and points apart from the center point by 0.1 mm on upstream and downstream, was measured, and a tangential line (tangential line of the projection portion) at the center point of the circle passing three points was determined. Further, a tangential line at a point on the surface of the developing roller which is positioned in the center direction of the developing roller cross section from the center point was similarly determined. The angle D which is formed between the two tangential lines at each point was measured. The angle D is positive when the tangential lines are opened toward the upstream in the rotating direction of the developing roller. The angle D is negative when the tangential lines are closed. The angle D has a maximum angle Dmax and a minimum angle Dmin. When the surface of the projection portion had a straight profile line, the straight line was defined as the tangential line of the projection portion, and the maximum angle Dmax and the minimum angle Dmin were similarly measured.

<Electrophotographic Image Forming Apparatus>

Figure 3:
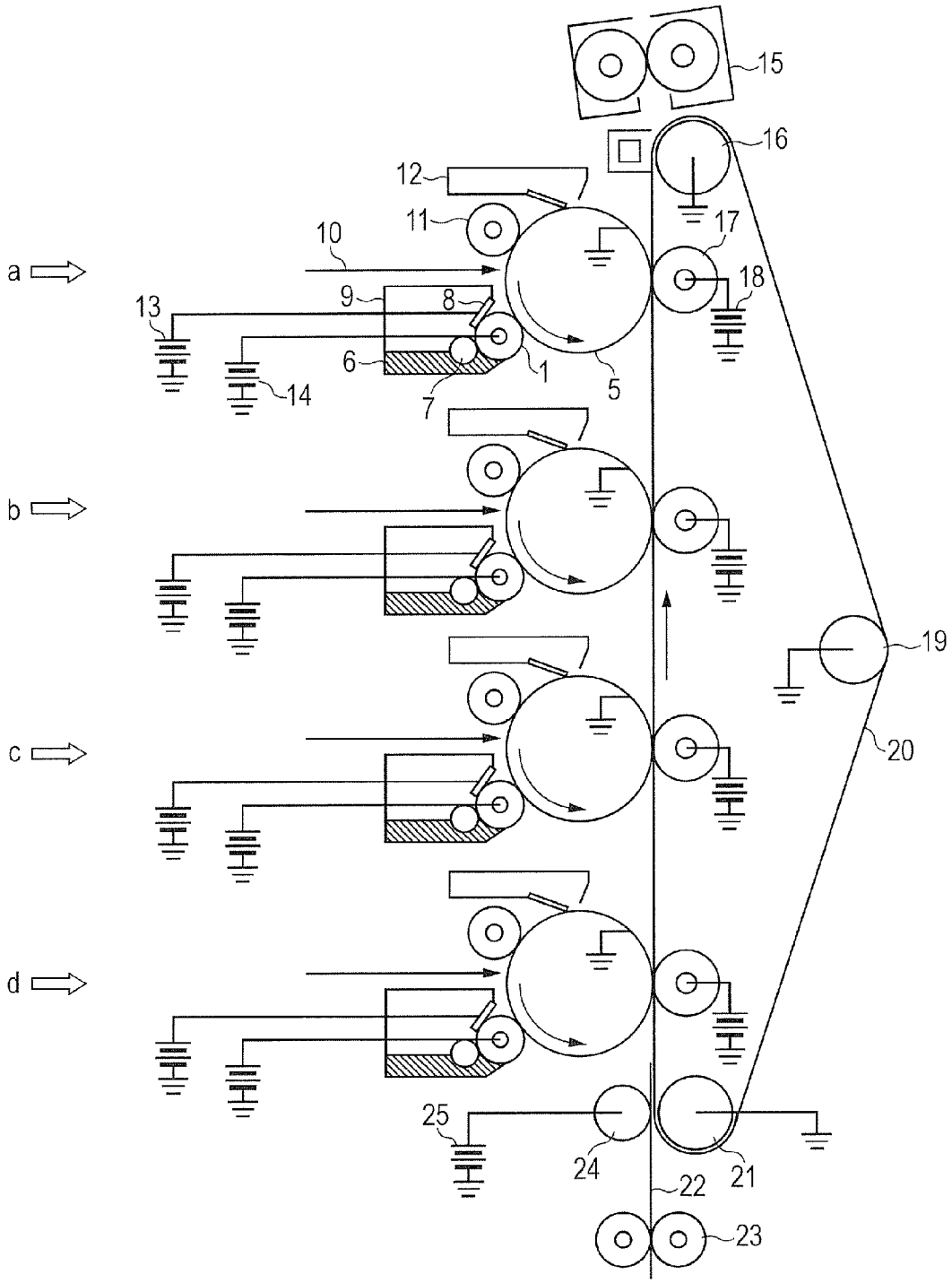
FIG. 3 is a schematic structural view for illustrating an example of an electrophotographic image forming apparatus according to the present invention.

An electrophotographic image forming apparatus of the present invention includes the developing apparatus according to the present invention. FIG. 3 is an illustration of an example of the electrophotographic image forming apparatus of the present invention. As illustrated in FIG. 3, image forming units a to d are arranged for respective color toners of a yellow toner, a magenta toner, a cyan toner, and a black toner. A photosensitive member 5 serving as an electrostatic latent image-bearing member rotating in a direction indicated by the arrow is arranged in each of the image forming units a to d. Arranged around each of the photosensitive members 5 are a charging apparatus 11 for uniformly charging the photosensitive member 5, an exposing unit (not shown) configured to irradiate the photosensitive member 5 uniformly subjected to the charging treatment with laser light 10 to form an electrostatic latent image, and a developing apparatus 9 configured to supply a toner to the photosensitive member 5 having formed thereon the electrostatic latent image to develop the electrostatic latent image.

Meanwhile, a transfer conveyance belt 20 configured to convey a recording material 22, such as paper, fed from a sheet-feeding roller 23 is arranged by being suspended over a driver roller 16, a driven roller 21, and a tension roller 19. The charge is adapted to the transfer conveyance belt 20 from an adsorption bias power source 25 through an adsorption roller 24 to electrostatically adhere the recording material 22 to the surface of the belt, thereby conveying the recording material. Further, to the respective image forming units a to d, a transfer bias power source 18 configured to apply charge for transferring the toner images on the photosensitive members 5 of the respective image forming units onto the recording material 22 is arranged. A transfer bias is applied through a transfer roller 17 arranged on the back surface of the transfer conveyance belt 20. The toner images of respective colors formed in the respective image forming units a to d are adapted to be sequentially superimposed and transferred onto the recording material 22 conveyed by the transfer conveyance belt 20 operated in synchronization with the respective image forming units a to d.

Further arranged in the electrophotographic image forming apparatus are a fixing apparatus 15 configured to fix the toner images superimposed and transferred onto the recording material 22 through heating or the like, and a conveying apparatus (not shown) configured to discharge the recording material 22 having formed thereon the images to the outside of the apparatus.

Meanwhile, a cleaning apparatus 12 having a cleaning blade configured to remove a transfer residual toner remaining on each of the photosensitive members 5 without being transferred to clean its surface is arranged in each of the image forming units. The cleaned photosensitive member 5 is adapted to be brought into an image formable state and to wait.

Arranged in the developing apparatus 9 arranged in each of the image forming units are a developer container 6 storing nonmagnetic developer (toner) as a one-component developer, and a developing roller 1 installed so that the roller closes the opening of the developer container 6 and a portion thereof exposed from the developer container faces the photosensitive member. Arranged in the developer container 6 are a developer-supplying roller 7 for supplying a toner to the developing roller 1, and at the same time, for scraping off the toner remaining on the developing roller 1 without being used after development, and a developer-regulating member 8 configured to form the toner on the developing roller 1 into a thin film shape, and to triboelectrically charge the toner. Those components are arranged to abut with the developing roller 1, and the developing roller 1 and the developer-supplying roller 7 each rotate in a forward direction. Charge in an amount sufficient for developing and visualizing an electrostatic latent image on the photosensitive member 5 as a toner image is applied to the developing roller 1 from a developing-roller bias power source 14. Further, predetermined voltage is applied to the developer-regulating member 8 from a blade bias power source 13.

<Electrophotographic Process Cartridge>

Figure 4:
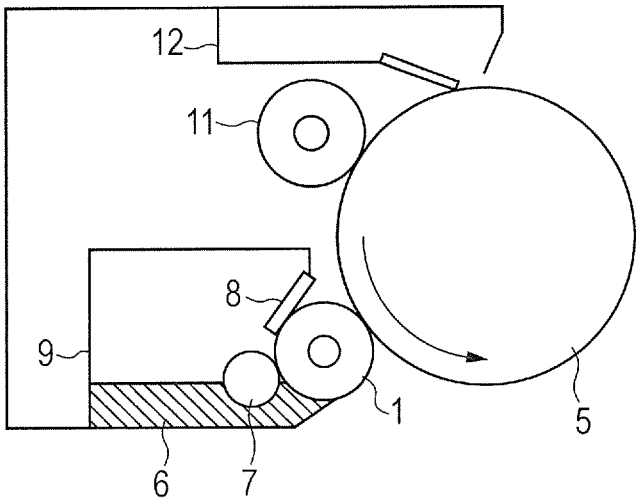
FIG. 4 is a schematic structural view for illustrating an example of an electrophotographic process cartridge according to the present invention.

An electrophotographic process cartridge of the present invention includes the developing apparatus of the present invention, and is detachably mounted onto the main body of an electrophotographic image forming apparatus. FIG. 4 is an illustration of an example of the electrophotographic process cartridge of the present invention. The electrophotographic process cartridge illustrated in FIG. 4 includes the developing apparatus 9, the photosensitive member 5, and the cleaning apparatus 12, and these components are integrated and are detachably mounted onto the main body of the electrophotographic image forming apparatus. Examples of the developing apparatus 9 can include the same apparatus as those of the image forming units described in the section "Electrophotographic Image Forming Apparatus." The electrophotographic process cartridge of the present invention may be such that in addition to the members, for example, a transfer member configured to transfer a toner image on the photosensitive member 5 onto the recording material 22 is integrally arranged together with the members.

In the present invention, a toner charge amount is preferably 25 μC/g or more, more preferably 35 ρC/g or more. In addition, a toner conveyance amount on the developing roller is preferably 0.30 mg/cm$^2$ or more, more preferably 0.35 mg/cm$^2$ or more.

According to one embodiment of the present invention, it is possible to obtain the developing apparatus that can achieve both the improvement in toner-conveying force and the excellent triboelectric charge imparting ability for a toner during printing of an image having a high density under the high-temperature and high-humidity environment, at high levels. In addition, according to another embodiment of the present invention, it is possible to obtain the electrophotographic process cartridge and the electrophotographic image forming apparatus, which are capable of obtaining uniformity of an image density, suppressing fogging regardless of an image density for printing, and stably providing high-quality images under various environments.

The present invention is specifically described below by way of Production Examples and Examples.

[Production Example 1] Production of Electro-Conductive Elastic Roller 1

Prepared as a substrate was a substrate obtained by applying and baking a primer (Product name: DY 35-051, manufactured by Dow Corning Toray Co., Ltd.) onto a mandrel made of stainless steel (SUS304) having an outer diameter of 6 mm and a length of 270 mm. The substrate was placed in a mold, and an addition-type silicone rubber composition obtained by mixing materials shown in Table 1 below was injected into a cavity formed in the mold. Subsequently, the mold was heated to heat and cure the silicone rubber at a temperature of 150° C. for 15 minutes, and the resultant was removed from the mold. After that, a curing reaction was completed by further heating the resultant at a temperature of 180° C. for 1 hour. Thus, an electro-conductive elastic roller 1 having an electro-conductive elastic layer having a thickness of 3 mm on the outer periphery of the substrate was produced.

TABLE 1

| Material | Part(s) by mass |
|---|---|
| Liquid silicone rubber material (Product name: SE6724A/B, manufactured by Dow Corning Toray Co., Ltd.) | 100 |
| Carbon black (Product name: TOKABLACK #7360SB, manufactured by Tokai Carbon Co., Ltd.) | 20 |
| Platinum catalyst | 0.1 |

[Production Example 2] Production of Electro-Conductive Elastic Roller 2

A substrate was prepared in the same manner as in Production Example 1. In addition, materials shown in Table 2 below were kneaded to prepare an unvulcanized rubber composition. Next, a crosshead extruder having a mechanism configured to supply the substrate and a mechanism configured to discharge the unvulcanized rubber composition was prepared. A die having an inner diameter of 12.1 mm was mounted on a crosshead, the temperatures of the extruder and the crosshead were adjusted to 30° C., and the speed at which the substrate was conveyed was adjusted to 60 mm/sec. Under the conditions, the unvulcanized rubber composition was supplied from the extruder, and the outer periphery of the substrate was covered with the unvulcanized rubber composition serving as an elastic layer in the crosshead. Thus, an unvulcanized rubber roller 2 was obtained. Next, the unvulcanized rubber roller 2 was loaded into a hot-air vulcanizing furnace at 170° C., and was heated for 15 minutes to vulcanize the rubber. Thus, an electro-conductive elastic roller 2 having an electro-conductive elastic layer having a thickness of 3 mm on the outer periphery of the substrate was produced.

TABLE 2

| Material | Part(s) by mass |
|---|---|
| Millable silicone rubber material (Product name: TSE270-4U, manufactured by Momentive Performance Materials Japan LLC) | 100 |
| Carbon black (Product name: TOKABLACK #7360SB, manufactured by Tokai Carbon Co., Ltd.) | 15 |
| Curing agent (Product name: TC-8, manufactured by Momentive Performance Materials Japan LLC) | 0.5 |

[Production Example 3] Production of Electro-Conductive Elastic Roller 3

Two kinds of materials shown in the column "Component 1" of Table 3 below were added to 200 parts by mass of methyl ethyl ketone (MEK), and the contents were mixed. Next, under a nitrogen atmosphere, the mixture was subjected to a reaction at a temperature of 80° C. for 4 hours to provide a polyurethane polyol prepolymer. The polyurethane polyol prepolymer of 100 parts by mass and other materials shown in the column "Component 2" of Table 3 below were added at blending ratios shown in Table 3 to 400 parts by mass of MEK so that a total solid content became 30 mass %, followed by stirring and dispersion in a ball mill.

TABLE 3

| Material | | Production Example | | | | |
|---|---|---|---|---|---|---|
| | | Production Example 3 | Production Example 7 | Production Example 8 | Production Example 9 | Production Example 10 |
| | | Additive amount (Part(s) by mass) | | | | |
| Component 1 | Polytetramethylene glycol (Product name: "PolyTHF", manufactured by BASF) | 100 | 100 | 100 | 100 | 100 |
| | Isocyanate (Product name: "Millionate MT" (MDI), manufactured by Tosoh Corporation) | 18 | 18 | 18 | 18 | 18 |
| Component 2 | Polyurethane polyol prepolymer | 100 | 100 | 100 | 100 | 100 |
| | Isocyanate (Product name: "CORONATE T-80", manufactured by Tosoh Corporation) | 45 | 45 | 45 | 45 | 45 |

TABLE 3-continued

| Material | Production Example | | | | |
|---|---|---|---|---|---|
| | Production Example 3 | Production Example 7 | Production Example 8 | Production Example 9 | Production Example 10 |
| | Additive amount (Part(s) by mass) | | | | |
| Acrylic resin (Product name: "HA3001", manufactured by Hitachi Chemical Co., Ltd.) | — | 1 | 3 | — | — |
| Polyether-modified silicone oil (Product name: "TSF4440", manufactured by Tanac Co., Ltd.) | — | — | — | 1 | 2 |
| Carbon black (Product name: "MA100", manufactured by Mitsubishi Chemical Corporation) | 36 | 36 | 36 | 36 | 36 |

In addition, an electro-conductive elastic roller 3' was produced in the same manner as in Production Example 1 by using the addition-type silicone rubber composition and a mold. Next, the dispersion liquid was used as an application liquid and applied to the electro-conductive elastic roller 3' by a dipping method so as to have a thickness of 10.0 μm. In the dipping method, the electro-conductive elastic roller 3' was immersed in the application liquid while the upper end portion of the substrate was held with the longitudinal direction of the roller set to a vertical direction. The time period for which the roller was immersed in the application liquid was set to 9 seconds, the initial and final speeds at which the roller was pulled up from the application liquid were set to 30 mm/s and 20 mm/s, respectively, and the speed was linearly changed with time between these speeds. The resultant applied product was dried in an oven at a temperature of 80° C. for 15 minutes, and was then subjected to a curing reaction in an oven at a temperature of 140° C. for 2 hours. Thus, an electro-conductive elastic roller 3 was produced. The electro-conductive elastic layer of the electro-conductive elastic roller 3 has a laminated structure including two layers.

[Production Example 4] Production of Electro-Conductive Elastic Roller 4

Three kinds of materials shown in Table 4 below were added to 465 parts by mass of MEK so that a total solid content became 25 mass %, followed by stirring and dispersion in a ball mill. Thus, a dispersion liquid was obtained. Next, an electro-conductive elastic roller 4 was produced in the same manner as in Production Example 3 except that the thickness of the dispersion liquid at the time of its application was set to 4.0 μm.

TABLE 4

| Material | Parts by mass |
|---|---|
| Poly(tetramethylene ether/3-methyltetra methylene ether) glycol (Product name: "PTG-L3000", manufactured by Hodogaya Chemical Co., Ltd.) | 100 |
| Isocyanate (HDI, manufactured by Tosoh Corporation) | 30 |
| Carbon black (Product name: "MA100", manufactured by Mitsubishi Chemical Corporation) | 33 |

[Production Example 5] Production of Electro-Conductive Elastic Roller 5

Three kinds of materials shown in Table 5 below were added to 396 parts by mass of MEK so that a total solid content became 30 mass %, followed by stirring and dispersion in a ball mill. Thus, a dispersion liquid was obtained. Next, an electro-conductive elastic roller 5 was produced in the same manner as in Production Example 3.

TABLE 5

| Material | Parts by mass |
|---|---|
| Polyester polyol (Product name: "Kuraray Polyol P-3010", manufactured by Kuraray Co., Ltd.) | 100 |
| Isocyanate (MDI, manufactured by Tosoh Corporation) | 45 |
| Carbon black (Product name: "MA100", manufactured by Mitsubishi Chemical Corporation) | 36 |

[Production Example 6] Production of Electro-Conductive Elastic Roller 6

Two kinds of materials shown in Table 6 below were added to 680 parts by mass of MEK so that a total solid content became 15 mass %, followed by stirring and dispersion in a ball mill. Thus, a dispersion liquid was obtained. Next, the dispersion liquid was applied by a dipping method in the same manner as in Production Example 3 except that its thickness at the time of the application was set to 3.0 μm. The resultant applied product was dried in an oven at a temperature of 100° C. for 15 minutes. Thus, an electro-conductive elastic roller 6 was produced.

TABLE 6

| Material | Parts by mass |
|---|---|
| Alcohol soluble nylon (Product name: "FINE RESIN FR-101", manufactured by Namariichi Co., Ltd.) | 100 |
| Carbon black (Product name: "MA100", manufactured by Mitsubishi Chemical Corporation) | 20 |

[Production Examples 7 to 10] Production of Electro-Conductive Elastic Rollers 7 to 10

Electro-conductive elastic rollers 7 to 10 were each produced in the same manner as in Production Example 3 except that the materials to be used for the preparation of the dispersion liquid were changed as shown in the column "Component 2" of Table 3.

[Production Example 11] Production of Electro-Conductive Elastic Roller 11

Three kinds of materials shown in Table 7 below were added to 336 parts by mass of MEK so that a total solid content became 30 mass %, followed by stirring and dispersion in a ball mill. Thus, a dispersion liquid was obtained. Next, an electro-conductive elastic roller 11 was produced in the same manner as in Production Example 3.

TABLE 7

| Material | Parts by mass |
|---|---|
| Polyester polyol (Product name: "Kuraray Polyol P-1010", manufactured by Kuraray Co., Ltd.) | 100 |
| Isocyanate (MDI, manufactured by Tosoh Corporation) | 15 |
| Carbon black (Product name: "MA100", manufactured by Mitsubishi Chemical Corporation) | 29 |

[Production Example 12] Production of Electro-Conductive Elastic Roller 12

Three kinds of materials shown in Table 8 below were added to 315 parts by mass of MEK so that a total solid content became 30 mass %, followed by stirring and dispersion in a ball mill. Thus, a dispersion liquid was obtained. Next, an electro-conductive elastic roller 12 was produced in the same manner as in Production Example 3.

TABLE 8

| Material | Parts by mass |
|---|---|
| Polyester polyol (Product name: "Kuraray Polyol P-520", manufactured by Kuraray Co., Ltd. | 100 |
| Isocyanate (MDI, manufactured by Tosoh Corporation) | 8 |
| Carbon black (Product name: "MA100", manufactured by Mitsubishi Chemical Corporation) | 27 |

[Production Example 21] Production of Insulating Domain Raw Material 1

Mixed to provide an insulating domain raw material 1 were 15 parts by mass of ethoxylated bisphenol A diacrylate (Product name: A-BPE-4, manufactured by Shin-Nakamura Chemical Co., Ltd.), 85 parts by mass of isobornyl acrylate (Product name: SR506NS, manufactured by Tomoe Engineering Co., Ltd.), and 5 parts by mass of 1-hydroxycyclohexyl phenyl ketone (Product name: IRGACURE 184, manufactured by BASF) serving as a photoinitiator.

[Production Examples 22 to 27] Production of Insulating Domain Raw Materials 2 to 7

Insulating domain raw materials 2 to 7 were obtained n the same manner as in Production Example 21 except that the kinds and usage amounts of the acrylate components were changed as shown in Table 9. Numerical values for the respective components in Table 9 are represented in the unit of "part(s) by mass."

TABLE 9

| | Production Example | | | | | | |
|---|---|---|---|---|---|---|---|
| | Production Example 21 | Production Example 22 | Production Example 23 | Production Example 24 | Production Example 25 | Production Example 26 | Production Example 27 |
| Insulating domain raw material No. | 1 | 2 | 3 | 4 | 5 | 6 | 7 |
| Ethoxylated bisphenol A diacrylate (Product name: A-BPE-4, manufactured by Shin-Nakamura Chemical Co., Ltd.) | 15 | 30 | 50 | — | — | 5 | 80 |
| Trimethylolpropane triacrylate (Product name: A-TMPT, manufactured by Shin-Nakamura Chemical Co., Ltd.) | — | — | — | 15 | 30 | — | — |
| Isobornyl acrylate (Product name: SR506NS, manufactured by Tomoe Engineering Co., Ltd.) | 85 | 70 | 50 | 85 | 70 | 95 | 0 |

TABLE 9-continued

| | Production Example | | | | | | |
|---|---|---|---|---|---|---|---|
| | Production Example 21 | Production Example 22 | Production Example 23 | Production Example 24 | Production Example 25 | Production Example 26 | Production Example 27 |
| 1-Hydroxycyclohexyl phenyl ketone (Product name: IRGACURE 184, manufactured by BASF) | 5 | 5 | 5 | 5 | 5 | 5 | 5 |
| Methyl ethyl ketone | — | — | — | — | — | — | 20 |

[Production and Physical Property Evaluations of Developing Roller]

[Production Example A1] Production of Developing Roller 1

Figure 5:
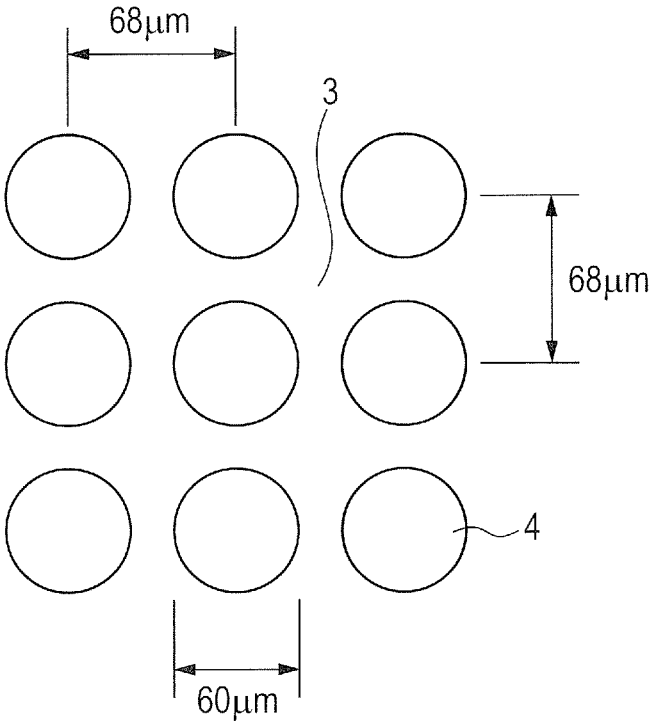
FIG. 5 is an example of a front observation view of insulating domains of the present invention.
Figure 6:
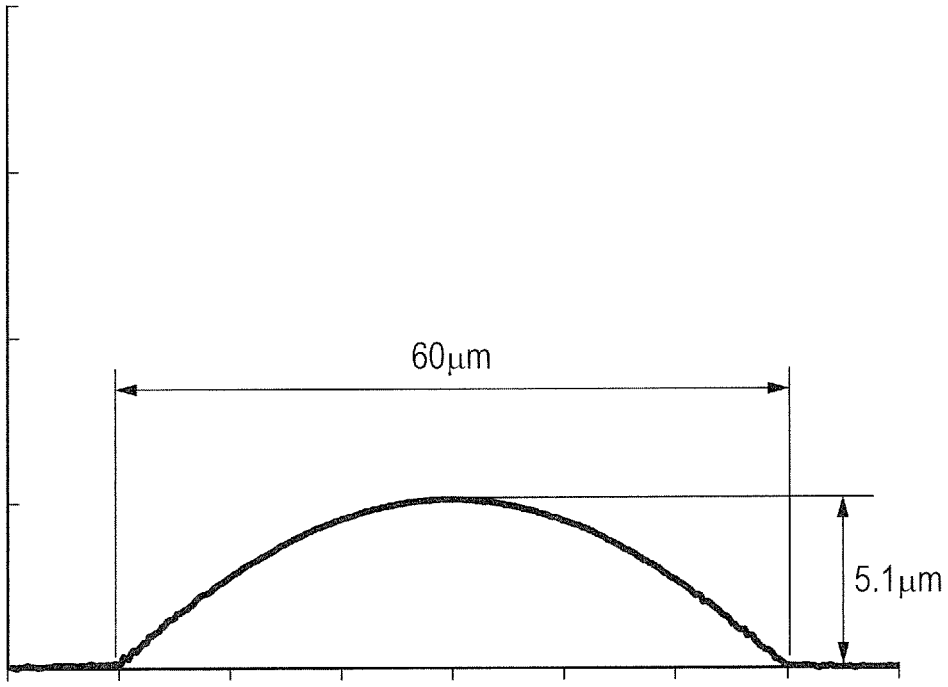
FIG. 6 is a graph for showing an example of a result of measurement for a height of each of the insulating domains of the present invention.

The droplet amount of the insulating domain raw material 2 obtained in Production Example 22 was adjusted to 15 pl by using a piezoelectric inkjet head. After that, the raw material was applied onto the peripheral surface of the electro-conductive elastic roller 3 obtained in Production Example 3. The application was performed while the electro-conductive elastic roller was rotated, and was performed so that intervals between insulating domains in the peripheral direction and longitudinal direction of the roller each became 75 μm. After that, the insulating domain raw material was cured by being irradiated with UV light having a wavelength of 254 nm with a low-pressure mercury lamp for 10 minutes so that its integrated light quantity became 1,500 mJ/cm$^2$. Thus, a developing roller 1 was produced. The resultant developing roller 1 was measured for the Martens hardness and exposure ratio $R_E$ of the electro-conductive elastic layer, and the average of the intervals between the insulating domains and the average base area $S_D$, and the average $H_D$ of the heights, of the insulating domains in accordance with the methods of the present invention. FIG. 5 is an illustration of an example of a front observation view of the insulating domains. As illustrated in FIG. 5, each of the insulating domains had a substantially circular shape and had a diameter of 60 μm, and the interval between the insulating domains was 68 μm. In addition, an example of the results of the measurement of the heights of the insulating domains is illustrated in FIG. 6. As illustrated in FIG. 6, the average $H_D$ of the heights of the insulating domains was 5.1 μm. The results of the measurement are shown in Table 10.

[Production Examples A2 to A27] Production of Developing Rollers 2 to 19 and C1 to C8

Types of electro-conductive elastic rollers and types of insulating domain raw materials were changed as shown in Table 10, and the droplet amount of the insulating domain raw material were changed as appropriate. Other than those changes, developing rollers 2 to 19 and developing rollers C1 to C8 were manufactured by the same method as that for Production Example A1. Then, physical property measurement was performed in the manner similar to that for Production Example A1. The results of the measurement are shown in Table 10.

TABLE 10

| | | | | | | Insulating domain | | |
|---|---|---|---|---|---|---|---|---|
| | | Electro- | | Electro-conductive elastic layer | | Interval between | Average | |
| Production Example | Developing roller | conductive elastic roller No. | Insulating domain raw material No. | Martens hardness (N/mm$^2$) | Exposure ratio $R_E$ (%) | insulating domains (μm) | base area $S_D$ (μm$^2$) | Height $H_D$ (μm) |
| A1 | Developing roller 1 | 3 | 2 | 0.50 | 40 | 68 | 2.83.E+03 | 5.1 |
| A2 | Developing roller 2 | 3 | 2 | 0.50 | 50 | 90 | 3.22.E+03 | 4.9 |
| A3 | Developing roller 3 | 3 | 2 | 0.50 | 72 | 105 | 3.12.E+03 | 4.8 |
| A4 | Developing roller 4 | 3 | 2 | 0.50 | 80 | 120 | 2.83.E+03 | 5.0 |
| A5 | Developing roller 5 | 3 | 2 | 0.50 | 90 | 170 | 2.92.E+03 | 5.2 |
| A6 | Developing roller 6 | 3 | 1 | 0.50 | 66 | 30 | 3.00.E+02 | 2.0 |
| A7 | Developing roller 7 | 3 | 4 | 0.50 | 72 | 60 | 1.00.E+03 | 3.5 |
| A8 | Developing roller 8 | 3 | 5 | 0.50 | 70 | 210 | 1.33.E+04 | 3.3 |
| A9 | Developing roller 9 | 3 | 3 | 0.50 | 72 | 425 | 5.07.E+04 | 6.4 |
| A10 | Developing roller 10 | 7 | 2 | 0.50 | 71 | 590 | 1.00.E+05 | 6.0 |
| A11 | Developing roller 11 | 4 | 2 | 0.10 | 74 | 105 | 2.83.E+03 | 2.0 |

TABLE 10-continued

| Production Example | Developing roller | Electro-conductive elastic roller No. | Insulating domain raw material No. | Electro-conductive elastic layer: Martens hardness (N/mm$^2$) | Electro-conductive elastic layer: Exposure ratio $R_E$ (%) | Insulating domain: Interval between insulating domains (μm) | Insulating domain: Average base area $S_D$ (μm$^2$) | Insulating domain: Height $H_D$ (μm) |
|---|---|---|---|---|---|---|---|---|
| A12 | Developing roller 12 | 5 | 2 | 1.00 | 73 | 105 | 3.02.E+03 | 5.0 |
| A13 | Developing roller 13 | 11 | 2 | 3.00 | 70 | 105 | 3.02.E+03 | 5.3 |
| A14 | Developing roller 14 | 8 | 2 | 0.50 | 70 | 100 | 3.02.E+03 | 0.5 |
| A15 | Developing roller 15 | 7 | 2 | 0.50 | 70 | 100 | 3.02.E+03 | 1.0 |
| A16 | Developing roller 16 | 9 | 2 | 0.50 | 80 | 100 | 1.96.E+03 | 15.0 |
| A17 | Developing roller 17 | 10 | 2 | 0.50 | 80 | 90 | 1.59.E+03 | 17.0 |
| A18 | Developing roller 18 | 2 | 2 | 0.56 | 70 | 100 | 3.02.E+03 | 5.4 |
| A19 | Developing roller 19 | 6 | 2 | 0.90 | 70 | 100 | 3.02.E+03 | 5.3 |
| A20 | Developing roller C1 | 12 | 2 | 4.00 | 72 | 105 | 3.12.E+03 | 4.9 |
| A21 | Developing roller C2 | 1 | 2 | 0.09 | 77 | 93 | 1.96.E+03 | 6.0 |
| A22 | Developing roller C3 | 3 | 2 | 0.50 | 92 | 93 | 7.07.E+02 | 5.0 |
| A23 | Developing roller C4 | 3 | 2 | 0.50 | 34 | 85 | 4.78.E+03 | 5.0 |
| A24 | Developing roller C5 | 3 | 6 | 0.50 | 80 | 30 | 1.77.E+02 | 1.0 |
| A25 | Developing roller C6 | 3 | 7 | 0.50 | 58 | 590 | 1.45.E+05 | 16.5 |
| A26 | Developing roller C7 | 12 | 2 | 4.00 | 40 | 72 | 3.12.E+03 | 4.9 |
| A27 | Developing roller C8 | 12 | 2 | 4.00 | 90 | 180 | 3.12.E+03 | 4.9 |

Production and Physical Property Evaluations of Developer Regulating Member

[Production Example B1] Production of Developer Regulating Member 1

A polyester thermoplastic resin (TPEE) (Product name: HYTREL 4047N, manufactured by Du Pont-Toray Co., Ltd.) was used as a material for the blade portion of a developer regulating member. The thickness of the blade portion was set to 250 μm. A long sheet measuring 15.2 mm in length in a short direction by 0.08 mm in thickness, and made of stainless steel (SUS304) was used as the support portion of the member.

Figure 8A:
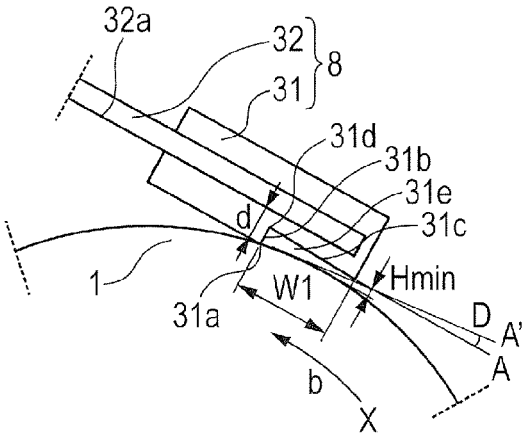
FIG. 8A, FIG. 8B, FIG. 8C, and FIG. 8D are enlarged sectional views for illustrating schematic structures of examples of the developing apparatus according to the present invention.
Figure 8B:
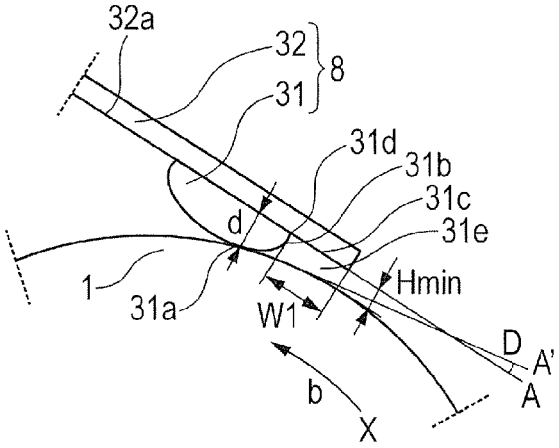
Figure 8C:
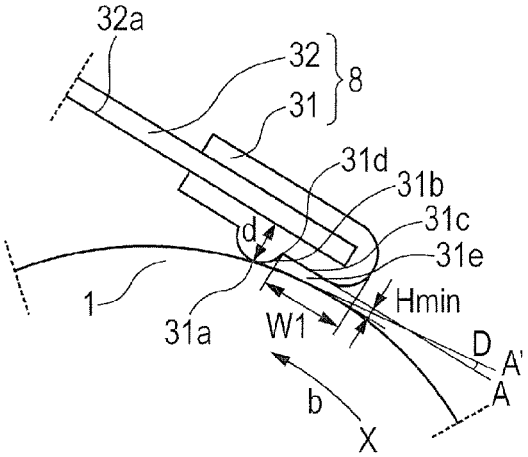

First, the material for the blade portion was melted in an extrusion molding machine at 200° C. and injected into the molding cavity of an extrusion molding die. At the same time, one end surface in the longitudinal direction of the support portion was covered with the blade portion while the one end surface of the support portion was caused to run in the molding cavity of the extrusion molding die. The temperature of the die was set to 250° C. The blade portion ejected from the extrusion molding die was solidified, and hence a long member of the developer regulating member in which the abutting support surface and apical surface of the support portion, and the surface thereof opposite to the abutting support surface were covered with the blade portion was obtained. The long member of the developer regulating member was cut so as to have a length in a longitudinal direction of 226 mm. Thus, a developer regulating member 1 was obtained. The developer regulating member 1 is a developer regulating member in which the profile line of the surface of a protruding portion is linear as illustrated in FIG. 8A.

A cross-sectional shape of the developer regulating member 1, which is taken along a direction perpendicular to the longitudinal direction of the developer regulating member 1, was observed through use of the digital microscope (Product name: VHX-5000, manufactured by Keyence Corporation) with magnification of 500 times. Then, the projection length W1 of the projection portion 31*c*, the height of the step of the step portion 31*b*, and an angle formed between the projection portion 31*c* and a support portion surface 32*a* at the root 31*d* (in Table 11, described as "Angle of projection portion root") were measured. The angle of the projection portion root was measured as an angle formed between a line connecting the root 31*d* of the projection portion to a point at a position apart from the root 31*d* by 0.1 mm in the projection portion distal end direction and the support portion surface 32*a*. When the support portion surface 32*a* was oriented downward, the direction in which the projection portion was opened toward a distal end side of the developer regulating member was set as a positive angle. The results of the observation are shown in Table 11.

[Production Examples B2 to B15 and B39 to B41] Production of Developer Regulating Members 2 to 15 and C1 to C3

Other than a change in shape of the extrusion molding die, developer regulating members 2 to 15 and C1 to C3 each having a straight profile line in the surface of the projection portion were produced in the manner similar to that for Production Example B1. Then, similarly to Production Example B1, the shape of the projection portion was observed. The results of the observation are shown together in Table 11.

[Production Examples B16 to B34] Production of Developer Regulating Members 16 to 34

Other than a change in shape of the extrusion molding die, developer regulating members 16 to 34 each having a curved profile line in the surface of the projection portion as illustrated in FIG. 9A were produced in a manner similar to that for Production Example B1. Further, other than the measurement of the curvature radius of the projection portion, the shape of the projection portion was observed in a manner similar to that for Production Example B1. A curvature radius of the projection portion (in Table 11, described as "Radius of projection portion") was measured as follows. At each point (however, excluding points at both ends) of 0.1 mm pitch along the projection portion 31*c*, a circle passing three points, which includes a center point and points apart from the center point by 0.1 mm on upstream and downstream, was measured, and an average of the radii of the circles each passing three points was determined as the curvature radius of the projection portion. Further, the angle formed between the projection portion 31*c* and the support portion surface 32*a* at the root 31*d* (angle of the projection portion root) in FIG. 9A to FIG. 9C was measured as an angle between the line connecting the root 31*d* of the projection portion to the point at a position apart from the root 31*d* by 0.1 mm in the distal end direction of the projection portion and the support portion surface 32*a*. The results of the observation of the projection portion are shown together in Table 11.

[Production Examples B35 and B36] Production of Developer Regulating Members 35 and 36

Other than a change in shape of the extrusion molding die, developer regulating members 35 and 36 each having a curved profile line in the surface of the projection portion as illustrated in FIG. 9B were produced in a manner similar to that for Production Example B1. The projection portion of the developer regulating member 35 has a shape formed of a bent straight line, and bent portions 31*f* are formed at positions trisecting the length of the surface of the projection portion so that each line segment has a length of 0.5 mm. Further, the developer regulating member 35 has such a shape that the angles D' of each bent portion is 175°, and the angle of the projection portion root is 5°. The projection portion of the developer regulating member 36 has a shape formed of a bent straight line, and bent portions 31*f* are formed at positions trisecting the length of the surface of the projection portion so that each line segment has a length of 0.7 mm. Further, the developer regulating member 36 has such a shape that the angles D' of each bent portion is 175°, and the angle of the projection portion root is 5°. The results of the observation of the projection portion are shown together in Table 11.

[Production Examples B37 and B38] Production of Developer Regulating Members 37 and 38

Figure 8D:
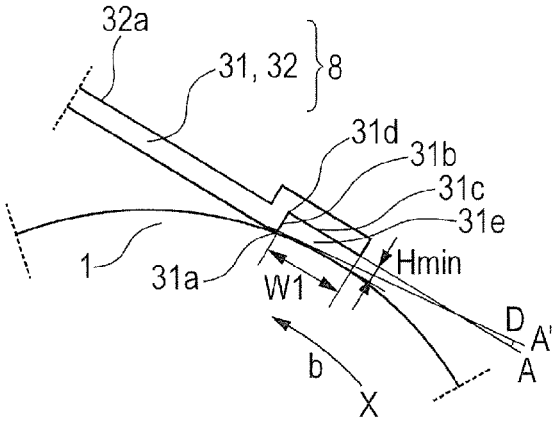

Developer regulating members 37 and 38, which each include the support portion and the blade portion integrally formed with use of a single material, were produced. The developer regulating members 37 and 38 were produced through press-working on an SUS-304-1/2H material having a short direction length of 17.9 mm, a longitudinal direction length of 226 mm, and a thickness of 0.08 mm. The developer regulating member 37 is a developer regulating member having a straight profile line in the surface of the projection portion as illustrated in FIG. 8D. The developer regulating member 38 is a developer regulating member having a curved profile line in the surface of the projection portion as illustrated in FIG. 9C. Similarly to Production Example B1 and Production Example B16, the shape of the projection portion was observed. The results of the observation of the projection portion are shown together in Table 11.

TABLE 11

| Production Example | Developer regulating member | Blade portion material | Projection portion shape | Projection length W1 (mm) | Height of step (mm) | Radius of projection portion (mm) | Angle of projection portion root (°) |
|---|---|---|---|---|---|---|---|
| B1 | Developer regulating member 1 | TPEE | Straight | 1.5 | 0.15 | — | 0 |
| B2 | Developer regulating member 2 | TPEE | Straight | 0.5 | 0.11 | — | 0 |
| B3 | Developer regulating member 3 | TPEE | Straight | 0.8 | 0.11 | — | 0 |
| B4 | Developer regulating member 4 | TPEE | Straight | 1.0 | 0.12 | — | 0 |
| B5 | Developer regulating member 5 | TPEE | Straight | 2.0 | 0.18 | — | 0 |
| B6 | Developer regulating member 6 | TPEE | Straight | 3.0 | 0.29 | — | 0 |
| B7 | Developer regulating member 7 | TPEE | Straight | 1.5 | 0.10 | — | 0 |

TABLE 11-continued

| Production Example | Developer regulating member | Blade portion material | Projection portion shape | Projection length W1 (mm) | Height of step (mm) | Radius of projection portion (mm) | Angle of projection portion root (°) |
|---|---|---|---|---|---|---|---|
| B8 | Developer regulating member 8 | TPEE | Straight | 1.5 | 0.25 | — | 0 |
| B9 | Developer regulating member 9 | TPEE | Straight | 1.5 | 0.35 | — | 0 |
| B10 | Developer regulating member 10 | TPEE | Straight | 1.5 | 0.54 | — | 0 |
| B11 | Developer regulating member 11 | TPEE | Straight | 0.5 | 0.50 | — | 0 |
| B12 | Developer regulating member 12 | TPEE | Straight | 1.5 | 0.20 | — | 3 |
| B13 | Developer regulating member 13 | TPEE | Straight | 1.5 | 0.20 | — | 5 |
| B14 | Developer regulating member 14 | TPEE | Straight | 1.5 | 0.10 | — | −3 |
| B15 | Developer regulating member 15 | TPEE | Straight | 1.5 | 0.06 | — | −5 |
| B16 | Developer regulating member 16 | TPEE | Curved | 1.5 | 0.10 | 6.1 | 7 |
| B17 | Developer regulating member 17 | TPEE | Curved | 0.5 | 0.10 | 6.1 | 7 |
| B18 | Developer regulating member 18 | TPEE | Curved | 0.8 | 0.10 | 6.1 | 7 |
| B19 | Developer regulating member 19 | TPEE | Curved | 1.0 | 0.10 | 6.1 | 7 |
| B20 | Developer regulating member 20 | TPEE | Curved | 2.0 | 0.10 | 6.1 | 7 |
| B21 | Developer regulating member 21 | TPEE | Curved | 3.0 | 0.10 | 6.1 | 7 |
| B22 | Developer regulating member 22 | TPEE | Curved | 1.5 | 0.05 | 6.1 | 7 |
| B23 | Developer regulating member 23 | TPEE | Curved | 1.5 | 0.20 | 6.2 | 7 |
| B24 | Developer regulating member 24 | TPEE | Curved | 1.5 | 0.30 | 6.3 | 7 |
| B25 | Developer regulating member 25 | TPEE | Curved | 1.5 | 0.50 | 6.5 | 7 |
| B26 | Developer regulating member 26 | TPEE | Curved | 0.5 | 0.50 | 6.5 | 7 |
| B27 | Developer regulating member 27 | TPEE | Curved | 1.5 | 0.18 | 6.1 | 10 |
| B28 | Developer regulating member 28 | TPEE | Curved | 1.5 | 0.18 | 6.1 | 13 |
| B29 | Developer regulating member 29 | TPEE | Curved | 1.5 | 0.10 | 6.1 | 4 |
| B30 | Developer regulating member 30 | TPEE | Curved | 1.5 | 0.06 | 6.1 | 2 |
| B31 | Developer regulating member 31 | TPEE | Curved | 1.5 | 0.12 | 12.1 | 3 |

TABLE 11-continued

| Production Example | Developer regulating member | Blade portion material | Projection portion shape | Projection length W1 (mm) | Height of step (mm) | Radius of projection portion (mm) | Angle of projection portion root (°) |
|---|---|---|---|---|---|---|---|
| B32 | Developer regulating member 32 | TPEE | Curved | 2.0 | 0.14 | 12.1 | 5 |
| B33 | Developer regulating member 33 | TPEE | Curved | 1.5 | 0.10 | 4.3 | 10 |
| B34 | Developer regulating member 34 | TPEE | Curved | 2.0 | 0.10 | 4.3 | 13 |
| B35 | Developer regulating member 35 | TPEE | Bent | 1.5 | 0.10 | — | 5 |
| B36 | Developer regulating member 36 | TPEE | Bent | 2.0 | 0.10 | — | 5 |
| B37 | Developer regulating member 37 | SUS | Straight | 1.5 | 0.10 | — | 0 |
| B38 | Developer regulating member 38 | SUS | Curved | 1.5 | 0.10 | 6.1 | 7 |
| B39 | Developer regulating member C1 | TPEE | Straight | 0.3 | 0.10 | — | 0 |
| B40 | Developer regulating member C2 | TPEE | Straight | 1.5 | 0.74 | — | 0 |
| B41 | Developer regulating member C3 | TPEE | Straight | 1.5 | 0.08 | — | 0 |

Example 1

[1. Production and Physical Property Evaluation of Developing Apparatus 1]

Figure 10:
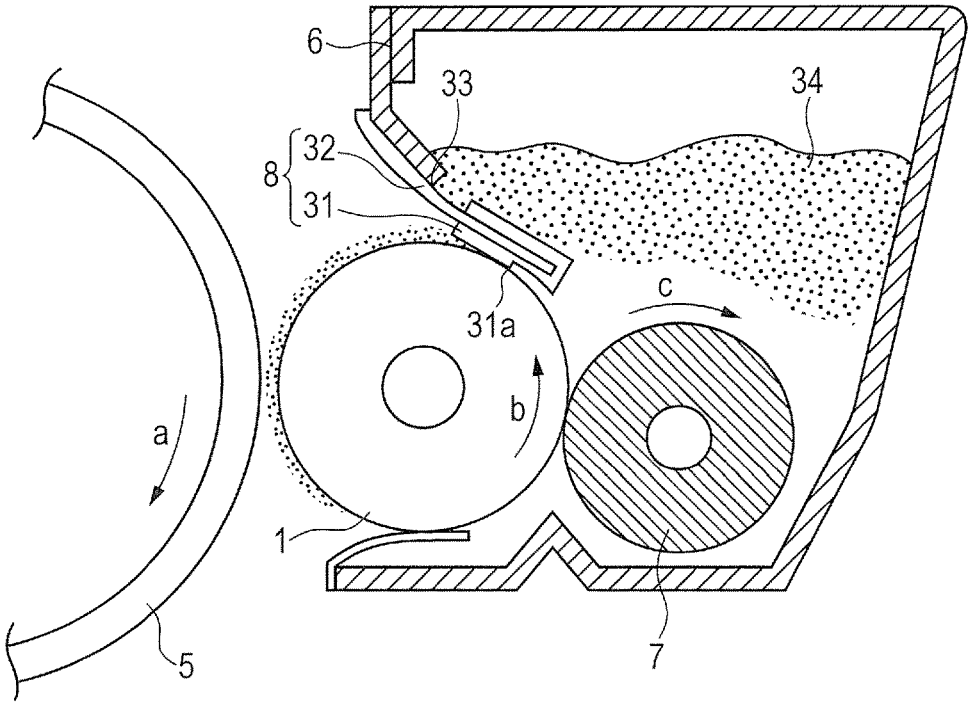
FIG. 10 is a sectional view for illustrating a schematic structure of an example of the electrophotographic process cartridge including the developing apparatus according to the present invention.

FIG. 10 is an illustration of an example of a sectional view for illustrating a part of a process cartridge including a developing apparatus produced in relation to Example 1 to Example 108, which is taken along a direction perpendicular to the longitudinal direction of the process cartridge. First, a gear of the process cartridge (Product name: CE263A Magenta, manufactured by Hewlett-Packard Company) was reconstructed for the purpose of a reduction in torque so that a developer-supplying roller is rotated in a forward direction c with respect to a rotating direction b of the developing roller at equal speed. Next, the developer regulating member was removed from the process cartridge, and the developer regulating member 1 obtained in Production Example B1 was mounted. Further, the developing roller was removed from the process cartridge, and the developing roller 1 obtained in Production Example A1 was mounted. Accordingly, a process cartridge including the developing apparatus 1 was obtained. For the obtained developing apparatus 1, values were measured by the above-mentioned measurement methods. The results of the measurement are shown in Table 14.

[2. Evaluation by Electrophotographic Image Forming Apparatus]

The process cartridge including the developing apparatus 1 was incorporated into an electrophotographic image forming apparatus (Product name: CLJCP4525, manufactured by Hewlett-Packard Company), and was then left to stand under a high-temperature and high-humidity environment having a temperature of 35° C. and a relative humidity of 85% for 24 hours.

[2-1. Evaluation for Fogging Immediately after Printing of Solid Black]

Next, during a course of printing one sheet of image, which has solid black (region having a maximum image density in a large area) in a region of 100 mm on upstream in the printing direction and solid white (region having a minimum image density in a large area) in a remaining region, at a speed of 10 sheets per minute, an operation of the printer is stopped. The timing of stopping the printer corresponds to a timing at which, after the solid black is developed by 100 mm from the developing roller onto the photosensitive member, the subsequent solid white is developed by about 20 mm from the developing roller onto the photosensitive member. With this, fogging in the first turn of the developing roller immediately after printing of solid black can be evaluated. Next, the toner adhering onto the region on the photosensitive member, at which the above-mentioned solid white is developed by about 20 mm in width, was peeled off with a transparent tape (Product name: Polyester Tape No. 550, manufactured by Nichiban Co., Ltd.), and was attached to white paper (Product name: Business Multipurpose 4200, manufactured by Xerox Corporation). Thus, a sample for evaluation was obtained. Next, a reflection density $R_1$ of the sample for evaluation was measured with a reflection densitometer (Product name: TC-6DS/A, manufactured by Tokyo Denshoku Co., Ltd.). At that time, a green filter was used as a filter. Meanwhile, a reflection density $R_0$ of a reference sample obtained by attaching only the transparent tape to the white paper was similarly measured. An amount "$R_0-R_1$" (%) by which the reflectance of the sample for evaluation reduced as compared to that of the reference sample was defined as a fogging value (%) immediately after printing of solid black. The results of the evaluation for fogging are shown in Table 19.

[2-2. Evaluation of Solid Black Image Density Difference and Second-Turn Image Density Difference]

Next, a black solid image of an A4 size was output on one sheet at a speed of 40 sheets per minute, the image density of the resultant black solid image was measured with a spectral densitometer (Product name: 508, manufactured by X-Rite Inc.). First, a density difference between a leading edge (position apart by 10 mm from an edge on upstream in the printing direction) and a trailing edge (position apart by 10 mm from an edge on downstream in the printing direction) of the image (trailing edge density-leading edge density) was determined as a solid black image density difference. The solid black image density difference is a value serving as an index of the toner-conveying force. Further, a density difference between the above-mentioned leading edge (position apart by 10 mm from the edge on upstream in the printing direction) and a second-turn position of the developing roller (position apart by 40 mm from the edge on upstream in the printing direction) of the image (second-turn density-leading edge density) was determined as a second-turn image density difference. The second-turn image density difference is a value serving as an index of aggregation of the toner in the gap portion, and has tendency of being degraded when the toner is excessively filled in the gap portion. The results of the evaluation of the solid black image density difference and the second-turn image density difference are shown in Table 19.

Examples 2 to 108 and Comparative Examples 1 to 15

Developing apparatus 2 to 108 of Examples 2 to 108 and developing apparatus C1 to C15 of Comparative Examples 1 to 15 were produced. The developing rollers and the developer regulating members were changed to those shown in Tables 12 and 13. Other than those changes, the developing rollers and the developer regulating members were the same as those of Example 1. Similarly to Example 1, shape measurement for the developing apparatus and evaluation by the electrophotographic image forming apparatus were performed. The results of the measurement for the developing apparatus are shown in Tables 14 to 18, and the results of the evaluation by the electrophotographic image forming apparatus are together shown in Tables 19 and 20.

TABLE 12

| Example | Developing apparatus No. | Developing roller No. | Developer regulating member No. |
|---|---|---|---|
| 1 | 1 | 1 | 1 |
| 2 | 2 | 2 | 1 |
| 3 | 3 | 3 | 1 |
| 4 | 4 | 4 | 1 |
| 5 | 5 | 5 | 1 |
| 6 | 6 | 6 | 1 |
| 7 | 7 | 7 | 1 |
| 8 | 8 | 8 | 1 |
| 9 | 9 | 9 | 1 |
| 10 | 10 | 10 | 1 |
| 11 | 11 | 11 | 1 |
| 12 | 12 | 12 | 1 |
| 13 | 13 | 13 | 1 |
| 14 | 14 | 14 | 1 |
| 15 | 15 | 15 | 1 |
| 16 | 16 | 16 | 1 |
| 17 | 17 | 17 | 1 |

TABLE 12-continued

| Example | Developing apparatus No. | Developing roller No. | Developer regulating member No. |
|---|---|---|---|
| 18 | 18 | 18 | 1 |
| 19 | 19 | 19 | 1 |
| 20 | 20 | 3 | 2 |
| 21 | 21 | 3 | 3 |
| 22 | 22 | 3 | 4 |
| 23 | 23 | 3 | 5 |
| 24 | 24 | 3 | 6 |
| 25 | 25 | 3 | 7 |
| 26 | 26 | 3 | 8 |
| 27 | 27 | 3 | 9 |
| 28 | 28 | 3 | 10 |
| 29 | 29 | 3 | 11 |
| 30 | 30 | 3 | 12 |
| 31 | 31 | 3 | 13 |
| 32 | 32 | 3 | 14 |
| 33 | 33 | 3 | 15 |
| 34 | 34 | 13 | 2 |
| 35 | 35 | 13 | 3 |
| 36 | 36 | 13 | 4 |
| 37 | 37 | 13 | 5 |
| 38 | 38 | 13 | 6 |
| 39 | 39 | 13 | 7 |
| 40 | 40 | 13 | 8 |
| 41 | 41 | 13 | 9 |
| 42 | 42 | 13 | 10 |
| 43 | 43 | 13 | 11 |
| 44 | 44 | 13 | 12 |
| 45 | 45 | 13 | 13 |
| 46 | 46 | 13 | 14 |
| 47 | 47 | 13 | 15 |
| 48 | 48 | 1 | 16 |
| 49 | 49 | 2 | 16 |
| 50 | 50 | 3 | 16 |
| 51 | 51 | 4 | 16 |
| 52 | 52 | 5 | 16 |
| 53 | 53 | 6 | 16 |
| 54 | 54 | 7 | 16 |
| 55 | 55 | 8 | 16 |
| 56 | 56 | 9 | 16 |
| 57 | 57 | 10 | 16 |
| 58 | 58 | 11 | 16 |
| 59 | 59 | 12 | 16 |
| 60 | 60 | 13 | 16 |
| 61 | 61 | 14 | 16 |
| 62 | 62 | 15 | 16 |
| 63 | 63 | 16 | 16 |
| 64 | 64 | 17 | 16 |
| 65 | 65 | 18 | 16 |
| 66 | 66 | 19 | 16 |

TABLE 13

| Example | Developing apparatus No. | Developing roller No. | Developer regulating member No. |
|---|---|---|---|
| 67 | 67 | 3 | 17 |
| 68 | 68 | 3 | 18 |
| 69 | 69 | 3 | 19 |
| 70 | 70 | 3 | 20 |
| 71 | 71 | 3 | 21 |
| 72 | 72 | 3 | 22 |
| 73 | 73 | 3 | 23 |
| 74 | 74 | 3 | 24 |
| 75 | 75 | 3 | 25 |
| 76 | 76 | 3 | 26 |
| 77 | 77 | 3 | 27 |
| 78 | 78 | 3 | 28 |
| 79 | 79 | 3 | 29 |
| 80 | 80 | 3 | 30 |
| 81 | 81 | 3 | 31 |

TABLE 13-continued

| | Developing apparatus No. | Developing roller No. | Developer regulating member No. |
|---|---|---|---|
| 82 | 82 | 3 | 32 |
| 83 | 83 | 3 | 33 |
| 84 | 84 | 3 | 34 |
| 85 | 85 | 13 | 17 |
| 86 | 86 | 13 | 18 |
| 87 | 87 | 13 | 19 |
| 88 | 88 | 13 | 20 |
| 89 | 89 | 13 | 21 |
| 90 | 90 | 13 | 22 |
| 91 | 91 | 13 | 23 |
| 92 | 92 | 13 | 24 |
| 93 | 93 | 13 | 25 |
| 94 | 94 | 13 | 26 |
| 95 | 95 | 13 | 27 |
| 96 | 96 | 13 | 28 |
| 97 | 97 | 13 | 29 |
| 98 | 98 | 13 | 30 |
| 99 | 99 | 13 | 31 |
| 100 | 100 | 13 | 32 |
| 101 | 101 | 13 | 33 |
| 102 | 102 | 13 | 34 |
| 103 | 103 | 13 | 35 |
| 104 | 104 | 13 | 36 |

TABLE 13-continued

| | Developing apparatus No. | Developing roller No. | Developer regulating member No. |
|---|---|---|---|
| 105 | 105 | 3 | 37 |
| 106 | 106 | 3 | 38 |
| 107 | 107 | 13 | 37 |
| 108 | 108 | 13 | 38 |
| Comparative Example | | | |
| 1 | C1 | C1 | 1 |
| 2 | C2 | C2 | 1 |
| 3 | C3 | C3 | 1 |
| 4 | C4 | C4 | 1 |
| 5 | C5 | C5 | 1 |
| 6 | C6 | C6 | 1 |
| 7 | C7 | C7 | 1 |
| 8 | C8 | C8 | 1 |
| 9 | C9 | C1 | 2 |
| 10 | C10 | C1 | 6 |
| 11 | C11 | C3 | 2 |
| 12 | C12 | C3 | 6 |
| 13 | C13 | 13 | C1 |
| 14 | C14 | 13 | C2 |
| 15 | C15 | 13 | C3 |

TABLE 14

| Example | Projection portion shape | Projection length W1 (mm) | Maximum value of distance Hmax (mm) | Minimum value of distance Hmin (mm) | Surface length W2 (mm) | Average gap distance Havg (mm) | Height change ratio (C) (—) | Maximum formed angle Dmax (°) | Minimum formed angle Dmin (°) |
|---|---|---|---|---|---|---|---|---|---|
| 1 | Straight | 1.5 | 0.15 | 0.10 | — | — | 1.5 | 7.2 | −7.2 |
| 2 | Straight | 1.5 | 0.15 | 0.10 | — | — | 1.5 | 7.2 | −7.2 |
| 3 | Straight | 1.5 | 0.15 | 0.10 | — | — | 1.5 | 7.2 | −7.2 |
| 4 | Straight | 1.5 | 0.15 | 0.10 | — | — | 1.5 | 7.2 | −7.2 |
| 5 | Straight | 1.5 | 0.15 | 0.10 | — | — | 1.5 | 7.2 | −7.2 |
| 6 | Straight | 1.5 | 0.15 | 0.10 | — | — | 1.5 | 7.2 | −7.2 |
| 7 | Straight | 1.5 | 0.15 | 0.10 | — | — | 1.5 | 7.2 | −7.2 |
| 8 | Straight | 1.5 | 0.15 | 0.10 | — | — | 1.5 | 7.2 | −7.2 |
| 9 | Straight | 1.5 | 0.15 | 0.10 | — | — | 1.5 | 7.2 | −7.2 |
| 10 | Straight | 1.5 | 0.15 | 0.10 | — | — | 1.5 | 7.2 | −7.2 |
| 11 | Straight | 1.5 | 0.15 | 0.10 | — | — | 1.5 | 7.2 | −7.2 |
| 12 | Straight | 1.5 | 0.15 | 0.10 | — | — | 1.5 | 7.2 | −7.2 |
| 13 | Straight | 1.5 | 0.15 | 0.10 | — | — | 1.5 | 7.2 | −7.2 |
| 14 | Straight | 1.5 | 0.15 | 0.10 | — | — | 1.5 | 7.2 | −7.2 |
| 15 | Straight | 1.5 | 0.15 | 0.10 | — | — | 1.5 | 7.2 | −7.2 |
| 16 | Straight | 1.5 | 0.15 | 0.10 | — | — | 1.5 | 7.2 | −7.2 |
| 17 | Straight | 1.5 | 0.15 | 0.10 | — | — | 1.5 | 7.2 | −7.2 |
| 18 | Straight | 1.5 | 0.15 | 0.10 | — | — | 1.5 | 7.2 | −7.2 |
| 19 | Straight | 1.5 | 0.15 | 0.10 | — | — | 1.5 | 7.2 | −7.2 |
| 20 | Straight | 0.5 | 0.11 | 0.10 | — | — | 1.1 | 2.4 | −2.4 |
| 21 | Straight | 0.8 | 0.11 | 0.10 | — | — | 1.1 | 3.6 | −3.6 |
| 22 | Straight | 1.0 | 0.12 | 0.10 | — | — | 1.2 | 5.1 | −5.1 |
| 23 | Straight | 2.0 | 0.18 | 0.10 | — | — | 1.8 | 10.0 | −10.0 |
| 24 | Straight | 3.0 | 0.29 | 0.10 | — | — | 2.9 | 15.1 | −15.1 |
| 25 | Straight | 1.5 | 0.10 | 0.05 | — | — | 2.0 | 7.2 | −7.2 |
| 26 | Straight | 1.5 | 0.25 | 0.20 | — | — | 1.2 | 7.2 | −7.2 |
| 27 | Straight | 1.5 | 0.35 | 0.30 | — | — | 1.1 | 7.2 | −7.2 |
| 28 | Straight | 1.5 | 0.54 | 0.50 | — | — | 1.1 | 7.2 | −7.2 |
| 29 | Straight | 0.5 | 0.50 | 0.50 | — | — | 1.0 | 2.4 | −2.4 |
| 30 | Straight | 1.5 | 0.20 | 0.10 | — | — | 1.9 | 4.5 | −10.5 |
| 31 | Straight | 1.5 | 0.20 | 0.06 | — | — | 3.2 | 2.4 | −12.5 |
| 32 | Straight | 1.5 | 0.20 | 0.10 | — | — | 1.9 | 10.5 | −4.5 |
| 33 | Straight | 1.5 | 0.20 | 0.06 | — | — | 3.1 | 12.4 | −2.5 |

TABLE 15

| Example | Projection portion shape | Projection length W1 (mm) | Maximum value of distance Hmax (mm) | Minimum value of distance Hmin (mm) | Surface length W2 (mm) | Average gap distance Havg (mm) | Height change ratio (C) (—) | Maximum formed angle Dmax (°) | Minimum formed angle Dmin (°) |
|---|---|---|---|---|---|---|---|---|---|
| 34 | Straight | 0.5 | 0.11 | 0.10 | — | — | 1.1 | 2.4 | −2.4 |
| 35 | Straight | 0.8 | 0.11 | 0.10 | — | — | 1.1 | 3.6 | −3.6 |
| 36 | Straight | 1.0 | 0.12 | 0.10 | — | — | 1.2 | 5.1 | −5.1 |
| 37 | Straight | 2.0 | 0.18 | 0.10 | — | — | 1.8 | 10.0 | −10.0 |
| 38 | Straight | 3.0 | 0.29 | 0.10 | — | — | 2.9 | 15.1 | −15.1 |
| 39 | Straight | 1.5 | 0.10 | 0.05 | — | — | 2.0 | 7.2 | −7.2 |
| 40 | Straight | 1.5 | 0.25 | 0.20 | — | — | 1.2 | 7.2 | −7.2 |
| 41 | Straight | 1.5 | 0.35 | 0.30 | — | — | 1.1 | 7.2 | −7.2 |
| 42 | Straight | 1.5 | 0.54 | 0.50 | — | — | 1.1 | 7.2 | −7.2 |
| 43 | Straight | 0.5 | 0.50 | 0.50 | — | — | 1.0 | 2.4 | −2.4 |
| 44 | Straight | 1.5 | 0.20 | 0.10 | — | — | 1.9 | 4.5 | −10.5 |
| 45 | Straight | 1.5 | 0.20 | 0.06 | — | — | 3.2 | 2.4 | −12.5 |
| 46 | Straight | 1.5 | 0.20 | 0.10 | — | — | 1.9 | 10.5 | −4.5 |
| 47 | Straight | 1.5 | 0.20 | 0.06 | — | — | 3.1 | 12.4 | −2.5 |

TABLE 16

| Example | Projection portion shape | Projection length W1 (mm) | Maximum value of distance Hmax (mm) | Minimum value of distance Hmin (mm) | Surface length W2 (mm) | Average gap distance Havg (mm) | Height change ratio (C) (—) | Maximum formed angle Dmax (°) | Minimum formed angle Dmin (°) |
|---|---|---|---|---|---|---|---|---|---|
| 48 | Curved | 1.5 | 0.10 | 0.10 | 1.5 | 0.10 | 1.0 | 0.3 | −0.3 |
| 49 | Curved | 1.5 | 0.10 | 0.10 | 1.5 | 0.10 | 1.0 | 0.3 | −0.3 |
| 50 | Curved | 1.5 | 0.10 | 0.10 | 1.5 | 0.10 | 1.0 | 0.3 | −0.3 |
| 51 | Curved | 1.5 | 0.10 | 0.10 | 1.5 | 0.10 | 1.0 | 0.3 | −0.3 |
| 52 | Curved | 1.5 | 0.10 | 0.10 | 1.5 | 0.10 | 1.0 | 0.3 | −0.3 |
| 53 | Curved | 1.5 | 0.10 | 0.10 | 1.5 | 0.10 | 1.0 | 0.3 | −0.3 |
| 54 | Curved | 1.5 | 0.10 | 0.10 | 1.5 | 0.10 | 1.0 | 0.3 | −0.3 |
| 55 | Curved | 1.5 | 0.10 | 0.10 | 1.5 | 0.10 | 1.0 | 0.3 | −0.3 |
| 56 | Curved | 1.5 | 0.10 | 0.10 | 1.5 | 0.10 | 1.0 | 0.3 | −0.3 |
| 57 | Curved | 1.5 | 0.10 | 0.10 | 1.5 | 0.10 | 1.0 | 0.3 | −0.3 |
| 58 | Curved | 1.5 | 0.10 | 0.10 | 1.5 | 0.10 | 1.0 | 0.3 | −0.3 |
| 59 | Curved | 1.5 | 0.10 | 0.10 | 1.5 | 0.10 | 1.0 | 0.3 | −0.3 |
| 60 | Curved | 1.5 | 0.10 | 0.10 | 1.5 | 0.10 | 1.0 | 0.3 | −0.3 |
| 61 | Curved | 1.5 | 0.10 | 0.10 | 1.5 | 0.10 | 1.0 | 0.3 | −0.3 |
| 62 | Curved | 1.5 | 0.10 | 0.10 | 1.5 | 0.10 | 1.0 | 0.3 | −0.3 |
| 63 | Curved | 1.5 | 0.10 | 0.10 | 1.5 | 0.10 | 1.0 | 0.3 | −0.3 |
| 64 | Curved | 1.5 | 0.10 | 0.10 | 1.5 | 0.10 | 1.0 | 0.3 | −0.3 |
| 65 | Curved | 1.5 | 0.10 | 0.10 | 1.5 | 0.10 | 1.0 | 0.3 | −0.3 |
| 66 | Curved | 1.5 | 0.10 | 0.10 | 1.5 | 0.10 | 1.0 | 0.3 | −0.3 |
| 67 | Curved | 0.5 | 0.10 | 0.10 | 0.5 | 0.10 | 1.0 | 0.1 | −0.1 |
| 68 | Curved | 0.8 | 0.10 | 0.10 | 0.8 | 0.10 | 1.0 | 0.1 | −0.1 |
| 69 | Curved | 1.0 | 0.10 | 0.10 | 1.0 | 0.10 | 1.0 | 0.2 | −0.2 |
| 70 | Curved | 2.0 | 0.10 | 0.10 | 2.0 | 0.10 | 1.0 | 0.3 | −0.3 |
| 71 | Curved | 3.0 | 0.10 | 0.10 | 3.0 | 0.10 | 1.0 | 0.5 | −0.5 |
| 72 | Curved | 1.5 | 0.05 | 0.05 | 1.5 | 0.05 | 1.0 | 0.3 | −0.3 |
| 73 | Curved | 1.5 | 0.20 | 0.20 | 1.5 | 0.20 | 1.0 | 0.3 | −0.3 |
| 74 | Curved | 1.5 | 0.30 | 0.30 | 1.5 | 0.30 | 1.0 | 0.3 | −0.3 |
| 75 | Curved | 1.5 | 0.50 | 0.50 | 1.5 | 0.50 | 1.0 | 0.3 | −0.3 |
| 76 | Curved | 0.5 | 0.50 | 0.50 | 0.5 | 0.50 | 1.0 | 0.1 | −0.1 |
| 77 | Curved | 1.5 | 0.19 | 0.12 | 1.5 | 0.15 | 1.6 | −2.6 | −3.0 |
| 78 | Curved | 1.5 | 0.19 | 0.06 | 1.5 | 0.13 | 2.9 | −4.6 | −5.0 |
| 79 | Curved | 1.5 | 0.18 | 0.10 | 1.5 | 0.14 | 1.8 | 3.0 | 2.8 |
| 80 | Curved | 1.5 | 0.19 | 0.06 | 1.5 | 0.12 | 3.0 | 5.0 | 4.9 |
| 81 | Curved | 1.5 | 0.12 | 0.10 | 1.5 | 0.11 | 1.2 | 3.8 | −3.8 |
| 82 | Curved | 2.0 | 0.14 | 0.10 | 2.0 | 0.11 | 1.4 | 5.0 | −5.0 |
| 83 | Curved | 1.5 | 0.12 | 0.10 | 1.5 | 0.11 | 1.2 | 2.9 | −2.9 |
| 84 | Curved | 2.0 | 0.14 | 0.10 | 2.0 | 0.13 | 1.3 | 3.9 | −3.9 |

TABLE 17

| Example | Projection portion shape | Projection length W1 (mm) | Maximum value of distance Hmax (mm) | Minimum value of distance Hmin (mm) | Surface length W2 (mm) | Average gap distance Havg (mm) | Height change ratio (C) (—) | Maximum formed angle Dmax (°) | Minimum formed angle Dmin (°) |
|---|---|---|---|---|---|---|---|---|---|
| 85 | Curved | 0.5 | 0.10 | 0.10 | 0.5 | 0.10 | 1.0 | 0.1 | −0.1 |
| 86 | Curved | 0.8 | 0.10 | 0.10 | 0.8 | 0.10 | 1.0 | 0.1 | −0.1 |
| 87 | Curved | 1.0 | 0.10 | 0.10 | 1.0 | 0.10 | 1.0 | 0.2 | −0.2 |
| 88 | Curved | 2.0 | 0.10 | 0.10 | 2.0 | 0.10 | 1.0 | 0.3 | −0.3 |
| 89 | Curved | 3.0 | 0.10 | 0.10 | 3.0 | 0.10 | 1.0 | 0.5 | −0.5 |
| 90 | Curved | 1.5 | 0.05 | 0.05 | 1.5 | 0.05 | 1.0 | 0.3 | −0.3 |
| 91 | Curved | 1.5 | 0.20 | 0.20 | 1.5 | 0.20 | 1.0 | 0.3 | −0.3 |
| 92 | Curved | 1.5 | 0.30 | 0.30 | 1.5 | 0.30 | 1.0 | 0.3 | −0.3 |
| 93 | Curved | 1.5 | 0.50 | 0.50 | 1.5 | 0.50 | 1.0 | 0.3 | −0.3 |
| 94 | Curved | 0.5 | 0.50 | 0.50 | 0.5 | 0.50 | 1.0 | 0.1 | −0.1 |
| 95 | Curved | 1.5 | 0.19 | 0.12 | 1.5 | 0.15 | 1.6 | −2.6 | −3.0 |
| 96 | Curved | 1.5 | 0.19 | 0.06 | 1.5 | 0.13 | 2.9 | −4.6 | −5.0 |
| 97 | Curved | 1.5 | 0.18 | 0.10 | 1.5 | 0.14 | 1.8 | 3.0 | 2.8 |
| 98 | Curved | 1.5 | 0.19 | 0.06 | 1.5 | 0.12 | 3.0 | 5.0 | 4.9 |
| 99 | Curved | 1.5 | 0.12 | 0.10 | 1.5 | 0.11 | 1.2 | 3.8 | −3.8 |
| 100 | Curved | 2.0 | 0.14 | 0.10 | 2.0 | 0.11 | 1.4 | 5.0 | −5.0 |
| 101 | Curved | 1.5 | 0.12 | 0.10 | 1.5 | 0.11 | 1.2 | 2.9 | −2.9 |
| 102 | Curved | 2.0 | 0.14 | 0.10 | 2.0 | 0.13 | 1.3 | 3.9 | −3.9 |
| 103 | Bent | 1.5 | 0.12 | 0.10 | 1.5 | 0.11 | 1.2 | 2.6 | −4.6 |
| 104 | Bent | 2.0 | 0.14 | 0.10 | 2.0 | 0.12 | 1.4 | 5.2 | −5.2 |
| 105 | Straight | 1.5 | 0.15 | 0.10 | — | — | 1.5 | 7.2 | −7.2 |
| 106 | Curved | 1.5 | 0.10 | 0.10 | 1.5 | 0.10 | 1.0 | 0.3 | −0.3 |
| 107 | Straight | 1.5 | 0.15 | 0.10 | — | — | 1.5 | 7.2 | −7.2 |
| 108 | Curved | 1.5 | 0.10 | 0.10 | 1.5 | 0.10 | 1.0 | 0.3 | −0.3 |

TABLE 18

| Comparative Example | Projection portion shape | Projection length W1 (mm) | Maximum value of distance Hmax (mm) | Minimum gap distance Hmin (mm) | Surface length W2 (mm) | Average gap distance Havg (mm) | Height change ratio (C) (—) | Maximum formed angle Dmax (°) | Minimum formed angle Dmin (°) |
|---|---|---|---|---|---|---|---|---|---|
| 1 | Straight | 1.5 | 0.15 | 0.10 | — | — | 1.5 | 7.2 | −7.2 |
| 2 | Straight | 1.5 | 0.15 | 0.10 | — | — | 1.5 | 7.2 | −7.2 |
| 3 | Straight | 1.5 | 0.15 | 0.10 | — | — | 1.5 | 7.2 | −7.2 |
| 4 | Straight | 1.5 | 0.15 | 0.10 | — | — | 1.5 | 7.2 | −7.2 |
| 5 | Straight | 1.5 | 0.15 | 0.10 | — | — | 1.5 | 7.2 | −7.2 |
| 6 | Straight | 1.5 | 0.15 | 0.10 | — | — | 1.5 | 7.2 | −7.2 |
| 7 | Straight | 1.5 | 0.15 | 0.10 | — | — | 1.5 | 7.2 | −7.2 |
| 8 | Straight | 1.5 | 0.15 | 0.10 | — | — | 1.5 | 7.2 | −7.2 |
| 9 | Straight | 0.5 | 0.11 | 0.10 | — | — | 1.1 | 2.4 | −2.4 |
| 10 | Straight | 3.0 | 0.29 | 0.10 | — | — | 2.9 | 15.1 | −15.1 |
| 11 | Straight | 0.5 | 0.11 | 0.10 | — | — | 1.1 | 2.4 | −2.4 |
| 12 | Straight | 3.0 | 0.29 | 0.10 | — | — | 2.9 | 15.1 | −15.1 |
| 13 | Straight | 0.3 | 0.10 | 0.10 | — | — | 1.0 | 1.4 | −1.4 |
| 14 | Straight | 1.5 | 0.74 | 0.70 | — | — | 1.1 | 7.2 | −7.2 |
| 15 | Straight | 1.5 | 0.05 | 0.00 | — | — | — | 7.2 | −7.2 |

TABLE 19

| Example | Developing apparatus No. | Fogging value immediately after printing of solid black image (%) | Solid black image density difference (—) | Second-turn density difference (—) |
|---|---|---|---|---|
| 1 | 1 | 4.2 | −0.15 | 0.07 |
| 2 | 2 | 3.7 | −0.05 | 0.07 |
| 3 | 3 | 3.1 | −0.02 | 0.07 |
| 4 | 4 | 3.2 | −0.04 | 0.07 |
| 5 | 5 | 3.3 | −0.14 | 0.07 |
| 6 | 6 | 3.9 | −0.17 | 0.07 |
| 7 | 7 | 3.1 | −0.17 | 0.07 |
| 8 | 8 | 3.2 | −0.08 | 0.08 |
| 9 | 9 | 4.5 | −0.06 | 0.07 |

TABLE 19-continued

| | | | | |
|---|---|---|---|---|
| 10 | 10 | 5.8 | −0.07 | 0.08 |
| 11 | 11 | 5.1 | −0.14 | 0.07 |
| 12 | 12 | 5.1 | −0.19 | 0.07 |
| 13 | 13 | 5.7 | −0.15 | 0.07 |
| 14 | 14 | 4.5 | −0.14 | 0.08 |
| 15 | 15 | 4.3 | −0.13 | 0.07 |
| 16 | 16 | 4.4 | −0.15 | 0.07 |
| 17 | 17 | 4.5 | −0.19 | 0.07 |
| 18 | 18 | 4.5 | −0.02 | 0.17 |
| 19 | 19 | 5.4 | −0.02 | 0.16 |
| 20 | 20 | 4.9 | −0.02 | 0.02 |
| 21 | 21 | 4.4 | −0.02 | 0.04 |
| 22 | 22 | 3.7 | −0.02 | 0.05 |
| 23 | 23 | 2.7 | −0.02 | 0.10 |
| 24 | 24 | 2.6 | −0.02 | 0.16 |
| 25 | 25 | 3.3 | −0.02 | 0.07 |
| 26 | 26 | 3.7 | −0.02 | 0.07 |
| 27 | 27 | 3.7 | −0.02 | 0.07 |

TABLE 19-continued

| | | | | |
|---|---|---|---|---|
| 28 | 28 | 5.0 | −0.02 | 0.07 |
| 29 | 29 | 5.8 | −0.02 | 0.02 |
| 30 | 30 | 2.9 | −0.02 | 0.10 |
| 31 | 31 | 3.0 | −0.02 | 0.12 |
| 32 | 32 | 3.2 | −0.02 | 0.05 |
| 33 | 33 | 4.1 | −0.02 | 0.02 |
| Example | Developing apparatus No. | Fogging value immediately after printing of solid black (%) | Solid black image density difference (—) | Second-turn density difference (—) |
| 34 | 34 | 7.7 | −0.15 | 0.02 |
| 35 | 35 | 7.3 | −0.16 | 0.04 |
| 36 | 36 | 6.3 | −0.16 | 0.05 |
| 37 | 37 | 4.8 | −0.16 | 0.10 |
| 38 | 38 | 4.2 | −0.16 | 0.16 |
| 39 | 39 | 6.0 | −0.15 | 0.07 |
| 40 | 40 | 6.4 | −0.15 | 0.07 |
| 41 | 41 | 6.8 | −0.16 | 0.07 |
| 42 | 42 | 8.6 | −0.16 | 0.07 |
| 43 | 43 | 9.7 | −0.15 | 0.02 |
| 44 | 44 | 5.0 | −0.16 | 0.11 |
| 45 | 45 | 4.9 | −0.16 | 0.12 |
| 46 | 46 | 5.7 | −0.16 | 0.05 |
| 47 | 47 | 6.9 | −0.16 | 0.02 |
| 48 | 48 | 3.1 | −0.14 | 0.00 |
| 49 | 49 | 3.0 | −0.05 | 0.00 |
| 50 | 50 | 2.5 | −0.02 | 0.00 |
| 51 | 51 | 2.6 | −0.04 | 0.00 |
| 52 | 52 | 2.6 | −0.13 | 0.00 |
| 53 | 53 | 3.1 | −0.18 | 0.00 |
| 54 | 54 | 2.4 | −0.17 | 0.00 |
| 55 | 55 | 2.5 | −0.08 | −0.01 |
| 56 | 56 | 3.4 | −0.06 | 0.02 |
| 57 | 57 | 4.5 | −0.07 | 0.01 |
| 58 | 58 | 4.2 | −0.14 | 0.00 |
| 59 | 59 | 3.9 | −0.19 | 0.01 |
| 60 | 60 | 4.3 | −0.15 | 0.02 |
| 61 | 61 | 3.7 | −0.14 | −0.01 |
| 62 | 62 | 3.1 | −0.13 | 0.01 |
| 63 | 63 | 3.2 | −0.15 | 0.01 |
| 64 | 64 | 3.2 | −0.18 | 0.02 |
| 65 | 65 | 3.4 | −0.02 | 0.03 |
| 66 | 66 | 4.2 | −0.02 | 0.00 |

TABLE 20

| | Developing apparatus No. | Fogging value immediately after printing of solid black (%) | Solid black image density difference (—) | Second-turn density difference (—) |
|---|---|---|---|---|
| Example | | | | |
| 67 | 67 | 4.2 | −0.02 | 0.03 |
| 68 | 68 | 3.7 | −0.02 | −0.01 |
| 69 | 69 | 3.0 | −0.02 | 0.00 |
| 70 | 70 | 1.4 | −0.02 | −0.01 |
| 71 | 71 | 1.0 | −0.02 | 0.00 |
| 72 | 72 | 2.4 | −0.02 | −0.01 |
| 73 | 73 | 2.9 | −0.02 | 0.00 |
| 74 | 74 | 3.1 | −0.02 | −0.02 |
| 75 | 75 | 3.5 | −0.02 | 0.00 |
| 76 | 76 | 4.3 | −0.02 | −0.01 |
| 77 | 77 | 2.4 | −0.02 | 0.03 |
| 78 | 78 | 2.4 | −0.02 | 0.04 |
| 79 | 79 | 2.3 | −0.02 | 0.01 |
| 80 | 80 | 2.7 | −0.02 | 0.00 |
| 81 | 81 | 2.6 | −0.02 | 0.04 |
| 82 | 82 | 1.6 | −0.02 | 0.04 |

TABLE 20-continued

| | Developing apparatus No. | Fogging value immediately after printing of solid black (%) | Solid black image density difference (—) | Second-turn density difference (—) |
|---|---|---|---|---|
| 83 | 83 | 2.4 | −0.02 | 0.03 |
| 84 | 84 | 1.5 | −0.02 | 0.02 |
| 85 | 85 | 7.9 | −0.16 | 0.00 |
| 86 | 86 | 6.3 | −0.16 | −0.01 |
| 87 | 87 | 5.7 | −0.16 | −0.02 |
| 88 | 88 | 3.4 | −0.16 | −0.02 |
| 89 | 89 | 2.5 | −0.16 | −0.01 |
| 90 | 90 | 4.4 | −0.16 | −0.01 |
| 91 | 91 | 4.5 | −0.16 | −0.01 |
| 92 | 92 | 5.3 | −0.15 | 0.00 |
| 93 | 93 | 6.7 | −0.16 | −0.02 |
| 94 | 94 | 7.1 | −0.16 | 0.00 |
| 95 | 95 | 4.3 | −0.16 | 0.03 |
| 96 | 96 | 4.9 | −0.16 | 0.03 |
| 97 | 97 | 4.1 | −0.15 | 0.01 |
| 98 | 98 | 4.9 | −0.15 | −0.02 |
| 99 | 99 | 4.5 | −0.15 | 0.02 |
| 100 | 100 | 2.8 | −0.16 | 0.04 |
| 101 | 101 | 4.2 | −0.15 | 0.02 |
| 102 | 102 | 2.7 | −0.16 | 0.03 |
| 103 | 103 | 4.5 | −0.15 | 0.03 |
| 104 | 104 | 3.6 | −0.15 | 0.05 |
| 105 | 105 | 3.2 | −0.02 | 0.08 |
| 106 | 106 | 2.2 | −0.02 | −0.01 |
| 107 | 107 | 5.5 | −0.16 | 0.06 |
| 108 | 108 | 4.0 | −0.15 | 0.01 |
| Comparative Example | | | | |
| 1 | C1 | 16.0 | −0.16 | 0.07 |
| 2 | C2 | 18.8 | −0.24 | 0.07 |
| 3 | C3 | 15.1 | −0.40 | 0.05 |
| 4 | C4 | 13.2 | −0.23 | 0.07 |
| 5 | C5 | 12.0 | −0.47 | 0.04 |
| 6 | C6 | 12.4 | −0.19 | 0.06 |
| 7 | C7 | 23.8 | −0.17 | 0.06 |
| 8 | C8 | 13.7 | −0.18 | 0.07 |
| 9 | C9 | 14.3 | −0.17 | 0.01 |
| 10 | C10 | 14.1 | −0.17 | 0.08 |
| 11 | C11 | 19.6 | −0.16 | 0.01 |
| 12 | C12 | 16.1 | −0.17 | 0.16 |
| 13 | C13 | 12.3 | −0.15 | 0.03 |
| 14 | C14 | 15.3 | −0.15 | 0.03 |
| 15 | C15 | 12.6 | −0.15 | 0.23 |

It is found from Examples 1, 3, 5, and 11 to 13, and Comparative Examples 1, 2, 7, and 8 that setting the Martens hardness of the electro-conductive elastic layer within the range of the present invention can achieve both a toner-conveying force and charge-providing performance for a toner during the printing of sold black under the high-temperature and high-humidity environment. It is found from Examples 1 to 5, and Comparative Examples 3 and 4 that setting the exposure ratio $R_E$ of the electro-conductive elastic layer within the range of the present invention can achieve both the toner-conveying force and the charge-providing performance for the toner under the high-temperature and high-humidity environment. It is found from Examples 3 and 6 to 10, and Comparative Examples 5 and 6 that setting the average base area $S_D$ of the insulating domains within the range of the present invention can achieve both the toner-conveying force and the charge-providing performance for the toner under the high-temperature and high-humidity environment. It is found from Examples 3 and 14 to 17 that setting the average $H_D$ of the heights of the insulating domains to 0.5 μm or more and 15.0 μm or less can achieve both the toner-conveying force and the charge-providing performance for the toner under the high-temperature and high-humidity environment. It is found from Examples 3 and 18 that setting the number of the electro-conductive elastic layers to two or more can achieve both the toner-conveying force and the charge-providing performance for the toner under the high-temperature and high-humidity environment. It is found from a comparison between Examples 3 and 19 that incorporating the polyurethane resin into the electro-conductive elastic layer can achieve both the toner-conveying force and the charge-providing performance for the toner under the high-temperature and high-humidity environment.

It is found from comparison of Examples 1 to 47 with Comparative Examples 13 to 15 that, when the projection portion within the range of the present invention is provided to the developer regulating member, the fogging immediately after printing of solid black is reduced. From this finding, it is conceivable that, when the gap portion is provided through use of the developer regulating member including the projection portion within the range of the present invention, the excellent triboelectric charge imparting ability for a toner is expressed also during printing of solid black.

Next, it is found from Examples 3, 13, 25 to 28, and 39 to 42, and Examples 50, 60, 72 to 75, and 90 to 93 that, when the minimum gap distance Hmin between the developing roller and the projection portion and the average gap distance Havg between the developing roller and the projection portion are reduced, the fogging immediately after printing of solid black tends to be reduced. Meanwhile, from Comparative Examples 14 and 15, when the developer regulating member having the minimum gap distance Hmin of more than 0.5 mm is used, or when the projection portion is held in contact with the developing roller (Hmin=0.00), the effect of the projection portion cannot be obtained satisfactorily, and reduction in fogging immediately after printing of solid black cannot not be observed. Those results indicate that the excellent triboelectric charge imparting ability for a toner is expressed as the distance between the developing roller and the projection portion is reduced so that filling of the toner into the gap portion can easily be performed. Further, it is conceivable that, when the projection portion is held in contact with the developing roller, the toner which is to be conveyed by the developing roller is scraped off by the projection portion on upstream of the gap portion, and filling of the toner into the gap portion is difficult.

Next, it is found from Examples 3, 13, 20 to 24, and 34 to 38, and Examples 50, 60, 67 to 71, and 85 to 89 that, when the projection length W1 or the length W2 of the profile line of the surface on which the distance with respect to the developing roller is 0.05 mm or more and 0.5 mm or less is set to be more than 0.5 mm, the fogging immediately after printing of solid black is reduced. Meanwhile, it is found from Comparative Example 13 that, when the projection length W1 is less than 0.5 mm, fogging immediately after printing of solid black is worse, and the effect of the projection portion is not obtained satisfactorily. It is conceivable that those results indicate that rubbing and rolling of a toner occur on the surface of the developing roller which passes through the gap portion, and that the excellent triboelectric charge imparting ability for a toner is more likely to be obtained by increasing the distance.

Next, it is found from comparison of Examples 1 to 47 with Examples 48 to 104 that, when the profile line of the surface of the projection portion has the shape of being curved in a concave shape, the fogging immediately after printing of solid black is further reduced, and the second-turn solid black image density difference is reduced. In particular, from comparison of Examples 3, 13, 20 to 24, 30 to 38, and 44 to 47 with Examples 50, 60, 67 to 71, 77 to 89, and 95 to 104, it is remarkable that, when the projection length is large, and the profile line of the surface of the projection portion has a curved profile line, the fogging immediately after printing of solid black and the second-turn solid black image density difference are reduced. It is conceivable that, in the case of the straight line shape, when the projection length is increased, an absolute value of the angle formed between the developing roller and the projection portion is increased, and hence the projection portion is excessively opened to cause the toner to be less liable to be filled, or the projection portion is excessively closed to cause the toner stagnation layer to be more liable to be formed, whereas those defects are suppressed due to the curved shape. Further, it is found from comparison of Examples 60, 88, and 99 to 102 with Examples 103 and 104 that, when the surface of the projection portion has a curved profile line, the increase in absolute value of the angle formed between the developing roller and the projection portion can be suppressed so that the second-turn solid black image density difference is reduced. Further, it is found from the comparison of Examples 3, 13, 50, and 60 with Examples 105 to 108 that the effect of the present invention can be obtained regardless of the material of the blade portion.

Next, it is found from Examples 3, 13, 20, 24, 34, and 38 with Comparative Examples 1, 9, and 10 that, when the developing roller including the electro-conductive elastic layer having the Martens hardness within the range of the present invention is combined with the developer regulating member including the projection portion within the range of the present invention, the triboelectric charge imparting ability for a toner during printing of solid black is expressed. It implies that the triboelectric charge imparting ability of the developing roller contributes to rubbing of the toner in the gap portion. Therefore, it is found that, only after the developing roller having the excellent triboelectric charge imparting ability for a toner within the range of the present invention is combined with the developer regulating member including the projection portion within the range of the present invention, both the toner-conveyance force and the triboelectric charge imparting ability for a toner during printing of solid black under the high-temperature and high-humidity environment can be achieved.

Further, it is found from Examples 3, 20, and 24, and Comparative Examples 3, 9, and 10 that, only after the developing roller including the electro-conductive elastic layer having the exposure ratio within the range of the present invention is combined with the developer regulating member including the projection portion within the range of the present invention, the triboelectric charge imparting ability for a toner during printing of solid black is expressed. This implies that the toner-conveying force, that is, the force of loading the toner into the gap portion contributes to rubbing of the toner in the gap portion. Therefore, it is found that, only after the developing roller having the excellent toner-conveying force within the range of the present invention is combined with the developer regulating member including the projection portion within the range of the present invention, both the toner-conveyance force and the triboelectric charge imparting ability for a toner during printing of solid black under the high-temperature and high-humidity environment can be achieved.

From the description above, the developing apparatus which includes the developing roller and the developer regulating member of the present invention can achieve both improvement in toner-conveying force and the excellent triboelectric charge imparting ability for a toner during printing of an image having high density under the high-temperature and high-humidity environment at high levels.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-150119, filed Jul. 29, 2016, which is hereby incorporated by reference herein in its entirety.

What is claimed is:

1. A developing apparatus, comprising:

a developing roller rotatable in a first rotation direction; and a developer regulating member which is configured to regulate a thickness of a developer layer on the developing roller, wherein the developing roller comprises:

a substrate;

an electro-conductive elastic layer on the substrate; and insulating domains on the electro-conductive elastic layer, wherein the electro-conductive elastic layer has a Martens hardness of 0.10 $N/mm^2$ or more and 3.00 $N/mm^2$ or less, the developing roller has a surface including surfaces of the insulating domains and a surface of the electro-conductive elastic layer, which is uncovered with the insulating domains, when assuming that a square of 900 μm on a side is put on a surface of the developing roller, a percentage ratio of an area of the surface of the electro-conductive elastic layer which is uncovered with the insulating domains with respect to an area of the square is 40% or more and 90% or less, and an average of respective areas of portions of the insulating domains, the portions being in contact with the surface of the electro-conductive elastic layer is $3.00\times10^2$ $\mu m^2$ or more and $1.00\times10^5$ $\mu m^2$ or less, wherein the developer regulating member comprises:

an abutting portion which is in contact with the surface of the developing roller directly or through a developer, and a projection portion extending to an upstream side from the abutting portion in the first rotation direction, the projection portion having a length W1 of 0.5 mm or more, the developing apparatus has a gap between a side of the projection portion facing to the developing roller, and the surface of the developing roller, and the gap has a minimum value of distance Hmin of 0.5 mm or less.

2. A developing apparatus according to claim 1, wherein an average of respective heights of the insulating domains is 0.5 μm or more and 15.0 μm or less.

3. A developing apparatus according to claim 1, wherein the electro-conductive elastic layer has a laminated structure including two or more layers.

4. A developing apparatus according to claim 1, wherein the electro-conductive elastic layer contains a polyurethane resin.

5. A developing apparatus according to claim 1, wherein the projection portion has a region at which a profile line of a surface of the projection portion in a side facing to the developing roller, has a concave shape to the developing roller, and wherein the region has an area at which the gap distance is 0.05 mm or more and 0.5 mm or less, and the area has a surface length W2 of 0.5 mm or more.

6. A developing apparatus according to claim 1, wherein a first tangential line at a first point, and a second tangential line at a second point, forms an angle of −5° or more and 5° or less, the first point being on a profile line of a surface of the projection portion in a side facing to the developing roller, and the second point being a cross point of:

a line connecting the first point and a rotation center of the developing roller, and a surface of the developing roller.

7. A developing apparatus according to claim 1, wherein when a maximum value of distance of the gap is defined as Hmax, the ratio of Hmax/Hmin is 1.0 or more and 3.0 or less.

8. An electrophotographic process cartridge, detachably mountable to a main body of an electrophotographic image forming apparatus, comprising a developing apparatus, wherein the developing apparatus comprises:

a developing roller rotatable in a first rotation direction; and a developer regulating member which is configured to regulate a thickness of a developer layer on the developing roller, wherein the developing roller comprises:

a substrate;

an electro-conductive elastic layer on the substrate; and insulating domains on the electro-conductive elastic layer, wherein the electro-conductive elastic layer has a Martens hardness of 0.10 $N/mm^2$ or more and 3.00 $N/mm^2$ or less, the developing roller has a surface including surfaces of the insulating domains and a surface of the electro-conductive elastic layer, which is uncovered with the insulating domains, when assuming that a square of 900 μm on a side is put on a surface of the developing roller, a percentage ratio of an area of the surface of the electro-conductive elastic layer which is uncovered with the insulating domains with respect to an area of the square is 40% or more and 90% or less, and an average of respective areas of portions of the insulating domains, the portions being in contact with the surface of the electro-conductive elastic layer is $3.00\times10^2$ $\mu m^2$ or more and $1.00\times10^5$ $\mu m^2$ or less, wherein the developer regulating member comprises:

an abutting portion which is in contact with the surface of the developing roller directly or through a developer, and a projection portion extending to an upstream side from the abutting portion in the first rotation direction, the projection portion having a length W1 of 0.5 mm or more, the developing apparatus has a gap between a side of the projection portion facing to the developing roller, and the surface of the developing roller, and the gap has a minimum value of distance Hmin of 0.5 mm or less.

9. An electrophotographic image forming apparatus, comprising a developing apparatus and a photosensitive member, wherein the developing apparatus comprises:

a developing roller rotatable in a first rotation direction; and a developer regulating member which is configured to regulate a thickness of a developer layer on the developing roller, wherein the developing roller comprises:

a substrate;

an electro-conductive elastic layer on the substrate; and insulating domains on the electro-conductive elastic layer, wherein the electro-conductive elastic layer has a Martens hardness of 0.10 $N/mm^2$ or more and 3.00 $N/mm^2$ or less, the developing roller has a surface including surfaces of the insulating domains and a surface of the electro-conductive elastic layer, which is uncovered with the insulating domains, when assuming that a square of 900 μm on a side is put on a surface of the developing roller, a percentage ratio of an area of the surface of the electro-conductive elastic layer which is uncovered with the insulating domains with respect to an area of the square is 40% or more and 90% or less, and an average of respective areas of portions of the insulating domains, the portions being in contact with the surface of the electro-conductive elastic layer is $3.00\times10^2$ $\mu m^2$ or more and $1.00\times10^5$ $\mu m^2$ or less, wherein the developer regulating member comprises:

an abutting portion which is in contact with the surface of the developing roller directly or through a developer, and a projection portion extending to an upstream side from the abutting portion in the first rotation direction, the projection portion having a length W1 of 0.5 mm or more, the developing apparatus has a gap between a side of the projection portion facing to the developing roller, and the surface of the developing roller, and the gap has a minimum value of distance Hmin of 0.5 mm or less, and wherein the developing roller is provided so as to face the photosensitive member.

* * * * *